US010118795B2

(12) United States Patent
Watanabe et al.

(10) Patent No.: US 10,118,795 B2
(45) Date of Patent: Nov. 6, 2018

(54) IMAGE FORMING APPARATUS PROVIDED WITH TRANSMISSION MECHANISM FOR TRANSMITTING DRIVE FORCE TO RECONVEYING ROLLER

(71) Applicant: Brother Kogyo Kabushiki Kaisha, Nagoya-shi, Aichi-ken (JP)

(72) Inventors: Tomonori Watanabe, Ichinomiya (JP); Hideaki Yoshimune, Nagoya (JP); Yurimi Hashimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/860,413

(22) Filed: Jan. 2, 2018

(65) Prior Publication Data

US 2018/0118506 A1 May 3, 2018

Related U.S. Application Data

(62) Division of application No. 15/390,998, filed on Dec. 27, 2016, now Pat. No. 9,896,302.

(30) Foreign Application Priority Data

Mar. 18, 2016 (JP) ..... 2016-056113
Mar. 18, 2016 (JP) ..... 2016-056114

(51) Int. Cl.
*B65H 29/00* (2006.01)
*B65H 85/00* (2006.01)
(Continued)

(52) U.S. Cl.
CPC ..... *B65H 85/00* (2013.01); *B65H 1/04* (2013.01); *B65H 3/0661* (2013.01); *B65H 5/062* (2013.01);
(Continued)

(58) Field of Classification Search
None
See application file for complete search history.

(56) References Cited

U.S. PATENT DOCUMENTS 6,257,569 B1 * 7/2001 Rhodes ..... B65H 3/0669 271/10.03
8,036,567 B2 10/2011 Hayakawa
(Continued)

FOREIGN PATENT DOCUMENTS

JP 4683058 B2 5/2011

*Primary Examiner* — Prasad V Gokhale
(74) *Attorney, Agent, or Firm* — Banner & Witcoff, Ltd.

(57) ABSTRACT

An image forming apparatus includes a reconveying unit including a reconveying roller; and a second transmission mechanism. The second transmission mechanism transmits a drive force to the reconveying roller and includes an input gear; an output gear; an intermediate gear including first and second gears; and first and second swinging gears. The first toothless part of the first gear and the second toothless part of the second gear are provided at such a position that, when the intermediate gear is rotated by a drive force transmitted from the input gear through the second swinging gear while the second swinging gear meshes with the second toothed part of the second gear and the output gear meshes with the first toothed part of the first gear, the first toothless part reaches a position confronting the output gear and then the second toothless part reaches a position confronting the second swinging gear.

5 Claims, 17 Drawing Sheets

(51) Int. Cl.

| | |
|---|---|
| ***B65H 5/36*** | (2006.01) |
| ***G03G 15/00*** | (2006.01) |
| ***B65H 3/06*** | (2006.01) |
| ***B65H 5/06*** | (2006.01) |
| ***B65H 9/00*** | (2006.01) |
| ***B65H 1/04*** | (2006.01) |
| ***G03G 15/23*** | (2006.01) |
| ***G03G 21/16*** | (2006.01) |

(52) U.S. Cl.

CPC ..... *B65H 5/36* (2013.01); *B65H 9/002* (2013.01); *G03G 15/234* (2013.01); *G03G 15/6529* (2013.01); *G03G 21/1647* (2013.01); *B65H 2403/40* (2013.01); *B65H 2403/422* (2013.01); *B65H 2403/50* (2013.01); *B65H 2403/81* (2013.01); *B65H 2405/20* (2013.01); *G03G 2215/00438* (2013.01); *G03G 2215/00586* (2013.01); *G03G 2221/1657* (2013.01)

(56) References Cited

U.S. PATENT DOCUMENTS

| | | | | |
|---|---|---|---|---|
| 9,897,961 | B2 * | 2/2018 | Watanabe | G03G 15/6529 |
| 2008/0265489 | A1 * | 10/2008 | Ng | B65H 3/0684 271/114 |
| 2009/0208242 | A1 | 8/2009 | Hayakawa | |
| 2014/0260739 | A1 * | 9/2014 | Hong | H04N 1/00649 74/354 |
| 2016/0334746 | A1 * | 11/2016 | Watanabe | G03G 15/6529 |
| 2016/0368722 | A1 * | 12/2016 | Toso | B65H 1/14 |

* cited by examiner

IMAGE FORMING APPARATUS PROVIDED WITH TRANSMISSION MECHANISM FOR TRANSMITTING DRIVE FORCE TO RECONVEYING ROLLER

CROSS REFERENCE TO RELATED APPLICATION

This application is a divisional application of prior U.S. application Ser. No. 15/390,998, filed Dec. 27, 2016, which claims priority from Japanese Patent Application Nos. 2016-056113 filed Mar. 18, 2016 and 2016-056114 filed Mar. 18, 2016. The entire content of each of the priority applications is incorporated herein by reference.

TECHNICAL FIELD

The present disclosure relates to an image forming apparatus capable of forming images on both sides of a sheet. The present disclosure also relates to a transmission mechanism that is provided in the image forming apparatus and configured to transmit a drive force.

BACKGROUND

There is conventionally known an image forming apparatus that forms images on both sides of a sheet. In such conventional apparatus, an image is formed on one side of the sheet at an image forming unit, and the sheet is discharged from the image forming unit. Then, the sheet is reconveyed to the image forming unit to form an image on the other side of the sheet.

In such a type of image forming apparatus that forms images on both sides of a sheet, the image forming unit forms an image on a sheet while conveying the sheet with a drive force from a motor rotating in a normal direction. Further, the image forming apparatus includes a switchback roller and a reconveying roller. The switchback roller conveys the sheet discharged from the image forming unit toward a discharge tray with the drive force from the motor rotating in the normal direction. The switchback roller also reconveys the sheet toward the image forming unit with a drive force from the motor rotating in a reverse direction. The reconveying roller reconveys the sheet toward the image forming unit regardless of the rotating direction of the motor. Rotating direction of the reconveying roller is unchanged regardless of the rotating direction of the motor.

There is conventionally known a transmission mechanism for transmitting a drive force of a motor to a roller, such as the reconveying roller, in order to rotate the roller in a constant rotational direction irrespective of a rotating direction of the motor. Such a transmission mechanism is disclosed in Japanese Patent No. 4683058. The following reference numerals are those allotted in the description of the Japanese Patent.

According to an image forming apparatus disclosed in the Japanese Patent, a motor 84, idle gears 91, 93, 95, 96 and a swinging gear 92 are provided. The idle gear 91 is rotationally driven by the motor 84. The swinging gear 92 is swingably moved about a rotation axis of the idle gear 91 while meshing with the idle gear 91. The swinging gear 92 is swingably moved downward to be separated from the idle gear 95 and to mesh with the idle gear 93 when the motor 84 is rotated in a normal direction. The swinging gear 92 is swingably moved upward to be separated from the idle gear 93 and to mesh with the idle gear 95 when the motor 84 is rotated in a reverse direction.

The idle gear 93 capable of meshing with the swinging gear 92 during normal rotation of the motor 84 meshes with a cleaner drive gear 94 for driving a cleaning roller 41 through a plurality of idle gears. The cleaning roller 41 is rotated in a predetermined direction when the motor 84 is rotated in the normal direction.

Further, the idle gear 95 capable of meshing with the swinging gear 92 during reverse rotation of the motor 84 meshes with the cleaner drive gear 94 through the idle gear 96. Thus, the cleaning roller 41 can be rotated in the predetermined direction even when the motor 84 is rotated in the reverse direction.

In this way, the drive force of the motor 84 can be transmitted to the cleaning roller 41 by way of a switching operation of the swinging gear 92 to switch a transmission route of the drive force from the motor 84 to the cleaning roller 41. Thus, the cleaning roller 41 can be rotated in the predetermined direction irrespective of the rotating direction of the motor 84.

SUMMARY

According to the transmission mechanism described in the Japanese Patent, the cleaning roller 41 is rotated in the predetermined direction irrespective of the rotating direction of the motor 84. Further, the cleaning roller 41 is rotationally driven at any time during normal rotation and reverse rotation of the motor 84.

Therefore, if such a transmission mechanism is applied for driving the reconveying roller of the image forming apparatus, the reconveying roller is rotationally driven at any time not only during reconveying of a sheet toward the image forming unit but also during image-formation on the sheet at the image forming unit. However, during the image formation, rotation of the reconveying roller is unnecessary.

If the reconveying roller is rotationally drive at any time, noise generation occurs due to unnecessary idle rotation of the reconveying roller during a period where a sheet-conveying operation by the reconveying roller is unnecessary. Further, continuous rotation of the reconveying roller may lead to early frictional wearing of the reconveying roller and a bearing of the reconveying roller.

Thus, in the image forming apparatus capable of forming images on both sides of a sheet, and in a transmission mechanism provided in such an image forming apparatus, desired is a secure stop of rotation of a reconveying roller during a period of non-conveyance of the sheet by the reconveying roller to reduce noise caused by the reconveying roller and to restrain frictional wearing of the reconveying roller and its neighboring mechanical component(s).

In view of the foregoing, it is an object of the disclosure to provide an image forming apparatus capable of forming images on both sides of a sheet and a transmission mechanism provided in the image forming apparatus, the transmission mechanism being capable of reliably stopping rotation of a reconveying roller during non-conveyance of a sheet by the reconveying roller.

In order to attain the above and other objects, according to one aspect, the disclosure provides an image forming apparatus including: a sheet support portion; an image forming unit; a tray; a conveying unit; a reconveying unit; a switchback roller; a drive source; a first transmission mechanism; and a second transmission mechanism. The sheet support portion is configured to support a sheet. The image forming unit is configured to form an image on the sheet. The tray is configured to support the sheet on which the image has been formed. The conveying unit is configured to convey the sheet along a conveying path. The conveying path leads from the sheet support portion to the tray via the image forming unit. The reconveying unit is configured to convey the sheet on which the image has been formed along a reconveying path. The reconveying path branches from the conveying path at a branch portion located between the image forming unit and the tray and rejoins the conveying path at a rejoining portion located between the sheet support portion and the image forming unit. The reconveying unit includes a reconveying roller configured to rotate in a reconveying mode for conveying the sheet in a first direction from the branch portion toward the rejoining portion. The switchback roller is configured to rotate in a first mode for conveying the sheet in a second direction from the image forming unit toward the tray and in a second mode for conveying the sheet in a third direction from the tray toward the reconveying unit. The drive source is configured to selectively rotate in a first rotational direction and in a second rotational direction opposite to the first rotational direction to supply a drive force for conveying the sheet. The first transmission mechanism transmits the drive force from the drive source to the conveying unit when the drive source rotates in the first rotational direction. The first transmission mechanism interrupts transmission of the drive force from the drive source to the conveying unit when the drive source rotates in the second rotational direction. The second transmission mechanism transmits the drive force from the drive source to the reconveying roller to rotate the reconveying roller in the reconveying mode when the drive source rotates in the second rotational direction. The second transmission mechanism transmits the drive force from the drive source to the reconveying roller to rotate the reconveying roller by predetermined numbers of rotations in the reconveying mode after the rotational direction of the drive source is switched from the second rotational direction to the first rotational direction and then interrupts transmission of the drive force from the drive source to the reconveying roller. The second transmission mechanism includes: an input gear; an output gear; an intermediate gear including a first gear and a second gear; a first swinging gear; a second swinging gear; a revolving member; an urging member; and a locking mechanism. The input gear has a rotation axis and is configured to rotate about the rotation axis upon receipt of the drive force from the drive source. The output gear is configured to output the drive force to the reconveying roller. The first gear includes a first toothed part and a first toothless part. The first toothed part has gear teeth and is capable of meshing with the output gear. The first toothless part has no gear teeth. The second gear includes a second toothed part having gear teeth and a second toothless part having no gear teeth. The first gear and the second gear are configured to rotate coaxially and integrally with each other. The first swinging gear meshes with the input gear and has a first rotational axis. The second swinging gear meshes with the input gear and has a second rotational axis. The revolving member supports the first swinging gear and the second swinging gear such that: the first swinging gear is rotatable about the first rotational axis; the second swinging gear is rotatable about the second rotational axis; and the first swinging gear and the second swinging gear are swingably movable about the rotation axis of the input gear while meshing with the input gear, respectively. The drive force transmitted from the drive source to the input gear acts as a revolving force for revolving the revolving member. The revolving member is configured to revolve between a first revolving position where the first swinging gear meshes with the output gear and the second swinging gear is separated from the second gear and a second revolving position where the first swinging gear is separated from the output gear and the second swinging gear is capable of meshing with the second gear. The revolving member is moved to the first revolving position when the drive source rotates in the second rotational direction and moved to the second revolving position when the drive source rotates in the first rotational direction. The urging member is configured to urge the intermediate gear in a rotating direction of the intermediate gear to rotate the intermediate gear from a first rotation position where the second toothed part is located at a position confronting the second swinging gear to a second rotation position where the second toothless part is located at a position confronting the second swinging gear while the first toothless part is located at a position confronting the output gear. The locking mechanism is configured to lock the rotation of the intermediate gear at the second rotation position. The first toothless part and the second toothless part are provided at such a position that, when the intermediate gear is rotated upon receipt of the drive force transmitted from the input gear through the second swinging gear while the second swinging gear meshes with the second toothed part and the output gear meshes with the first toothed part, the first toothless part reaches a position confronting the output gear and then the second toothless part reaches a position confronting the second swinging gear.

According to another aspect, the disclosure provides a transmission mechanism provided in an image forming apparatus including: an image forming unit configured to form an image on a sheet; a roller configured to convey the sheet; and a drive source configured to supply a drive force to the image forming unit and the roller. The transmission mechanism is configured to transmit the drive force from the drive source to the roller. The transmission mechanism includes: an input gear; an output gear; an intermediate gear including a first gear and a second gear; a first swinging gear; a second swinging gear; a revolving member; an urging member; and a locking mechanism. The input gear has a rotation axis and configured to rotate about the rotation axis upon receipt of the drive force from the drive source. The output gear is configured to output the drive force to the roller to rotate the roller. The first gear includes a first toothed part and a first toothless part. The first toothed part has gear teeth and is capable of meshing with the output gear. The first toothless part has no gear teeth. The second gear includes a second toothed part having gear teeth and a second toothless part having no gear teeth. The first gear and the second gear are configured to rotate coaxially and integrally with each other. The first swinging gear meshes with the input gear and has a first rotational axis. The second swinging gear meshes with the input gear and has a second rotational axis. The revolving member supports the first swinging gear and the second swinging gear such that: the first swinging gear is rotatable about the first rotation axis; the second swinging gear is rotatable about the second rotation axis; and the first swinging gear and the second swinging gear are swingably movable about the rotation axis of the input gear while meshing with the input gear, respectively. The drive force supplied from the drive source to the input gear acts as a revolving force for revolving the revolving member. The revolving member is configured to revolve between a first revolving position where the first swinging gear meshes with the output gear and the second swinging gear is separated from the second gear and a second revolving position where the first swinging gear is separated from the output gear and the second swinging gear is capable of meshing with the second gear. The revolving member is moved to the first revolving position when the input gear rotates in a first rotating direction and moved to the second revolving position when the input gear rotates in a second rotating direction. The urging member is configured to urge the intermediate gear in a rotating direction of the intermediate gear to rotate the intermediate gear from a first rotation position where the second toothed part is located at a position confronting the second swinging gear to a second rotation position where the second toothless part is located at a position confronting the second swinging gear while the first toothless part is located at a position confronting the output gear. The locking mechanism is configured to lock the rotation of the intermediate gear at the second rotation position. The first toothless part and the second toothless part are provided at such a position that, when the intermediate gear is rotated upon receipt of the drive force transmitted from the input gear through the second swinging gear while the second swinging gear meshes with the second toothed part and the output gear meshes with the first toothed part, the first toothless part reaches a position confronting the output gear and then the second toothless part reaches a position confronting the second swinging gear.

According to still another aspect, the disclosure provides an image forming apparatus including: a sheet support portion; an image forming unit; a tray; a conveying unit; a reconveying unit; a switchback roller; a drive source; a first transmission mechanism; and a second transmission mechanism. The sheet support portion is configured to support a sheet. The image forming unit is configured to form an image on the sheet. The tray is configured to support the sheet on which the image has been formed. The conveying unit is configured to convey the sheet along a conveying path. The conveying path leads from the sheet support portion to the tray via the image forming unit. The reconveying unit is configured to convey the sheet on which the image has been formed along a reconveying path. The reconveying path branches from the conveying path at a branch portion located between the image forming unit and the tray and rejoins the conveying path at a rejoining portion located between the sheet support portion and the image forming unit. The reconveying unit includes a reconveying roller configured to rotate in a reconveying mode for conveying the sheet in a first direction from the branch portion toward the rejoining portion. The switchback roller is configured to rotate in a first mode for conveying the sheet in a second direction from the image forming unit toward the tray and in a second mode for conveying the sheet in a third direction from the tray toward the reconveying unit. The drive source is configured to selectively rotate in a first rotational direction and in a second rotational direction opposite to the first rotational direction to supply a drive force for conveying the sheet. The first transmission mechanism transmits the drive force from the drive source to the conveying unit when the drive source rotates in the first rotational direction. The first transmission mechanism interrupts transmission of the drive force from the drive source to the conveying unit when the drive source rotates in the second rotational direction. The second transmission mechanism transmits the drive force from the drive source to the reconveying roller to rotate the reconveying roller in the reconveying mode when the drive source rotates in the second rotational direction. The second transmission mechanism transmits the drive force from the drive source to the reconveying roller to rotate the reconveying roller by predetermined numbers of rotations in the reconveying mode after the rotational direction of the drive source is switched from the second rotational direction to the first rotational direction and then interrupts transmission of the drive force from the drive source to the reconveying roller. The second transmission mechanism includes: an input gear; a first drive gear; a second drive gear; a first swinging gear; a second swinging gear; a first two-stage gear including a first intermediate gear and a sun gear; an internal gear; a plurality of planetary gears; a second intermediate gear; a one-way clutch; a revolving member; an urging member; and a locking mechanism. The input gear is configured to rotate upon receipt of the drive force from the drive source. The first drive gear is configured to output the drive force to the reconveying roller. The second drive gear is configured to rotate coaxially with the first drive gear. The first swinging gear meshes with the input gear. The second swinging gear meshes with the input gear. The first intermediate gear meshes with the second drive gear and has a first rotational axis. The sun gear is configured to rotate integrally with the first intermediate gear about the first rotational axis. The internal gear has an inner peripheral surface on which gear teeth are formed and has a center axis coincident with the first rotational axis. The internal gear is stationary and incapable of rotating. The plurality of planetary gears is disposed between the sun gear and the internal gear and meshes with the sun gear and the internal gear. The plurality of planetary gears each has a second rotational axis. The second intermediate gear is configured to rotate about the first rotational axis. The second intermediate gear supports the plurality of planetary gears such that the plurality of planetary gears is rotatable about the second rotational axes, respectively and orbitally movable about the first rotational axis. The second intermediate gear is configured to rotate relative to the first two-stage gear and the internal gear. The second intermediate gear includes a toothed part having gear teeth and a toothless part having no gear teeth. The one-way clutch is disposed between the first drive gear and the second drive gear. The one-way clutch transmits rotation of the second drive gear driven by the first intermediate gear to the first drive gear. The one-way clutch interrupts transmission of rotation of the first drive gear driven by the first swinging gear to the second drive gear. The revolving member supports the first swinging gear and the second swinging gear such that: the first swinging gear is rotatable about a rotation axis of the first swinging gear; the second swinging gear is rotatable about a rotation axis of the second swinging gear; and the first swinging gear and the second swinging gear are swingably movable about a rotation axis of the input gear while meshing with the input gear, respectively. The drive force transmitted from the drive source to the input gear acts as a revolving force for revolving the revolving member. The revolving member is configured to revolve between a first revolving position where the first swinging gear meshes with the first drive gear and the second swinging gear is separated from the second intermediate gear and a second revolving position where the first swinging gear is separated from the first drive gear and the second swinging gear is capable of meshing with the second intermediate gear. The revolving member is moved to the first revolving position when the drive source rotates in the second rotational direction and moved to the second revolving position when the drive source rotates in the first rotational direction. The urging member is configured to urge the second intermediate gear in a rotating direction of the second intermediate gear to rotate the second intermediate gear from a first rotation position where the toothed part is located at a position confronting the second swinging gear to a second rotation position where the toothless part is located at a position confronting the second swinging gear. The locking mechanism is configured to lock the rotation of the second intermediate gear at the second rotation position.

According to still another aspect, the disclosure provides a transmission mechanism provided in an image forming apparatus including: an image forming unit configured to form an image on a sheet; a roller configured to convey the sheet; and a drive source configured to supply a drive force to the image forming unit and the roller. The transmission mechanism is configured to transmit the drive force from the drive source to the roller. The transmission mechanism includes: an input gear; a first drive gear; a second drive gear; a first swinging gear; a second swinging gear; a first two-stage gear including a first intermediate gear and a sun gear; an internal gear; a plurality of planetary gears; a second intermediate gear; a one-way clutch; a revolving member; an urging member; and a locking mechanism. The input gear is configured to rotate upon receipt of the drive force from the drive source. The first drive gear is configured to output the drive force to the roller. The second drive gear is configured to rotate coaxially with the first drive gear. The first swinging gear meshes with the input gear. The second swinging gear meshes with the input gear. The first intermediate gear meshes with the second drive gear and has a first rotational axis. The sun gear is configured to rotate integrally with the first intermediate gear about the first rotational axis. The internal gear has an inner peripheral surface on which gear teeth are formed and has a center axis coincident with the first rotational axis. The internal gear is stationary and incapable of rotating. The plurality of planetary gears is disposed between the sun gear and the internal gear and meshes with the sun gear and the internal gear. The plurality of planetary gears each has a second rotational axis. The second intermediate gear is configured to rotate about the first rotational axis. The second intermediate gear supports the plurality of planetary gears such that the plurality of planetary gears is rotatable about the second rotational axes, respectively and orbitally movable about the first rotation axis. The second intermediate gear is configured to rotate relative to the first two-stage gear and the internal gear. The second intermediate gear includes a toothed part having gear teeth and a toothless part having no gear teeth. The one-way clutch is disposed between the first drive gear and the second drive gear. The one-way clutch transmits rotation of the second drive gear driven by the first intermediate gear to the first drive gear. The one-way clutch interrupts transmission of rotation of the first drive gear driven by the first swinging gear to the second drive gear. The revolving member supports the first swinging gear and the second swinging gear such that: the first swinging gear is rotatable about a rotation axis of the first swinging gear; the second swinging gear is rotatable about a rotation axis of the second swinging gear; and the first swinging gear and the second swinging gear are swingably movable about a rotation axis of the input gear while meshing with the input gear, respectively. The drive force supplied from the drive source to the input gear acts as a revolving force for revolving the revolving member. The revolving member is configured to revolve between a first revolving position where the first swinging gear meshes with the first drive gear and the second swinging gear is separated from the second intermediate gear and a second revolving position where the first swinging gear is separated from the first drive gear and the second swinging gear is capable of meshing with the second intermediate gear. The revolving member is moved to the first revolving position when the input gear rotates in a first rotating direction and moved to the second revolving position when the input gear rotates in a second rotating direction. The urging member is configured to urge the second intermediate gear in a rotating direction of the second intermediate gear to rotate the second intermediate gear from a first rotation position where the toothed part is located at a position confronting the second swinging gear to a second rotation position where the toothless part is located at a position confronting the second swinging gear. The locking mechanism is configured to lock the rotation of the second intermediate gear at the second rotation position.

BRIEF DESCRIPTION OF THE DRAWINGS

The particular features and advantages of the embodiment(s) as well as other objects will become apparent from the following description taken in connection with the accompanying drawings, in which:

FIG. 3B particularly illustrates a relationship between the output gear and a first gear;

FIG. 4B particularly illustrates the relationship between the output gear and the first gear;

FIG. 5B particularly illustrates the relationship between the output gear and the first gear;

FIG. 6B particularly illustrates the relationship between the output gear and the first gear which is a part of the intermediate gear;

FIG. 7B particularly illustrates the relationship between the output gear and the first gear;

DETAILED DESCRIPTION

<First Embodiment>

Figure 1:
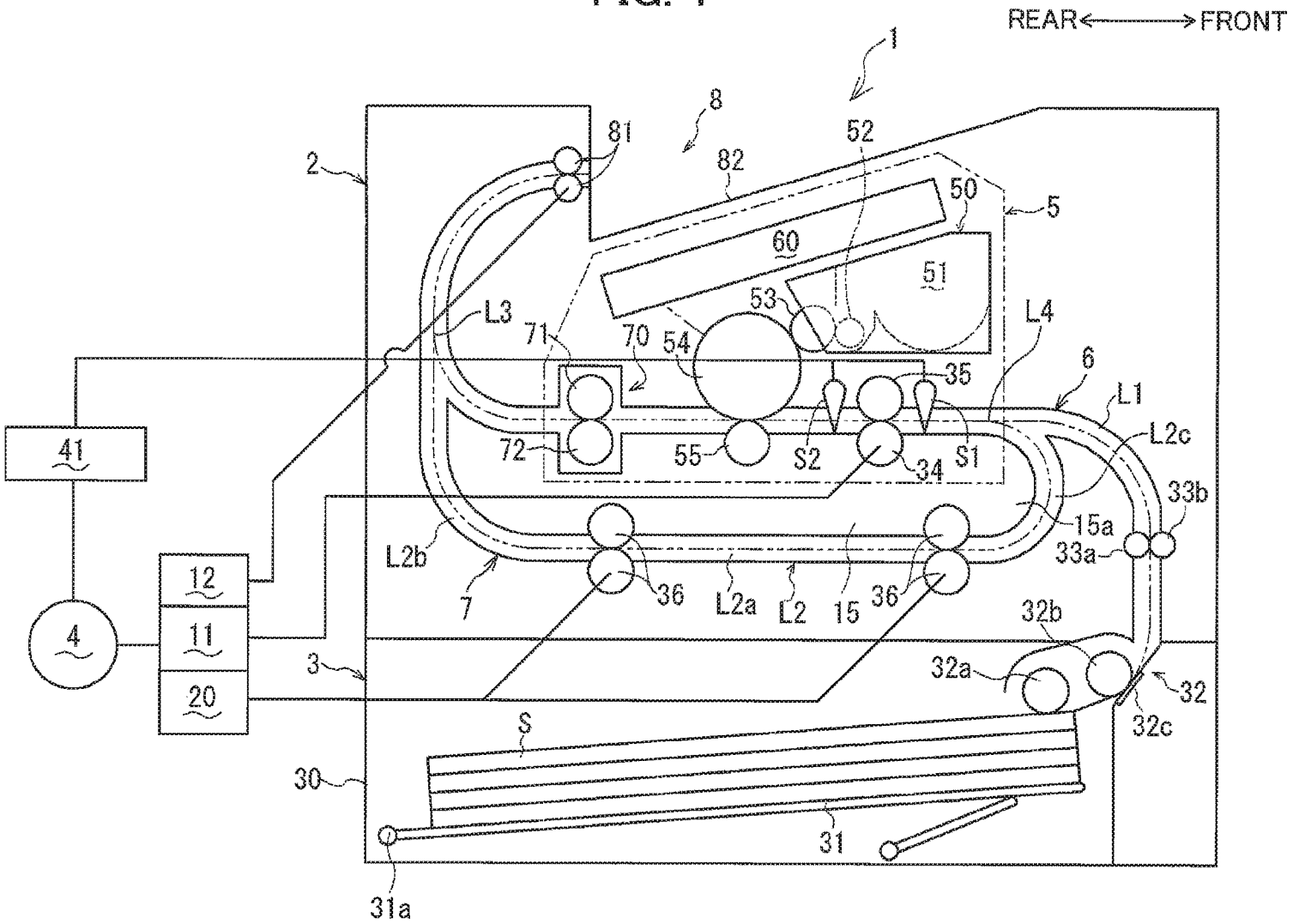
FIG. 1 is a schematic center cross-sectional view of an image forming apparatus according to a first embodiment.

An image forming apparatus 1 according to a first embodiment will be described with reference to FIGS. 1 through 11, wherein like parts and components are designated by the same reference numerals to avoid duplicating description.

<Overall Structure of Image Forming Apparatus>

As illustrated in FIG. 1, the image forming apparatus 1 includes: a main casing 2; a sheet supply unit 3; an image forming unit 5; a conveying unit 6 for conveying a sheet S along a conveying path L1; a reconveying unit 7 for conveying the sheet S along a reconveying path L2; two pairs of reconveying rollers 36, 36 provided at the reconveying unit 7; a discharge unit 8 including a pair of switchback rollers 81, 81 and a discharge tray 82 as an example of a tray; a motor 4 as an example of a drive source for supplying a drive force; a first transmission mechanism 11; a second transmission mechanism 20 as an example of a transmission mechanism; and a third transmission mechanism 12.

The sheet supply unit 3 is positioned at a lower portion of the main casing 2. The sheet supply unit 3 is configured to convey the sheets S placed in the sheet supply unit 3 to the image forming unit 5. The image forming unit 5 is positioned downstream relative to the sheet supply unit 3 in a conveying direction of the sheet S. The image forming unit 5 is configured to form an image on the sheet S supplied from the sheet supply unit 3. The discharge unit 8 is positioned downstream relative to the image forming unit 5 in the conveying direction. The discharge unit 8 is configured to discharge the sheet S on which the image has been formed to an outside of the main casing 2. The discharge unit 8 is also configured to reconvey the sheet S to the image forming unit 5.

The first transmission mechanism 11 is configured to transmit the drive force supplied from the motor 4 to the conveying unit 6 for conveying the sheet S along the conveying path L1. The second transmission mechanism 20 is configured to transmit the drive force supplied from the motor 4 to the reconveying unit 7 for conveying the sheet S along a reconveying path L2, more specifically, the reconveying rollers 36, 36. The third transmission mechanism 12 is configured to transmit the drive force supplied from the motor 4 to the switchback rollers 81, 81.

The sheet supply unit 3 includes: a sheet cassette 30 as an example of a sheet support portion for supporting the sheets S; a sheet feeding mechanism 32; a conveying roller 33*a*; and a registration roller 34. The sheet feeding mechanism 32, the conveying roller 33*a*, the registration roller 34, and the like constitute the conveying unit 6 for conveying the sheet S along the conveying path L1.

The sheet cassette 30 is detachably attached to the lower portion of the main casing 2. That is, the sheet cassette 30 is movable between an attached position at which the sheet cassette 30 is attached to the main casing 2 and a detached position at which the sheet cassette 30 is detached from or pulled out of the main casing 2.

In the following description, the pulled-out direction of the sheet cassette 30 (i.e. the direction that the sheet cassette 30 at the attached position is pulled out of the main casing 2) is defined as a forward direction with respect to the image forming apparatus 1, while the attaching direction of the sheet cassette 30 (i.e. the direction that the sheet cassette 30 at the detached position is attached to main casing 2) is defined as a rearward direction with respect to the image forming apparatus 1.

The sheet cassette 30 includes a lifter plate 31 on which the sheets S are stacked. The lifter plate 31 has a pivot shaft 31*a*, and is pivotally movable in a vertical direction about the pivot shaft 31*a* by the drive force from the motor 4. Pivotal movement of the lifter plate 31 allows the sheets S placed on the lifter plate 31 moves upward and downward. Hence, the sheets S placed on the lifter plate 31 moves upward as the lifter plate 31 pivotally moves upward, so that the sheets S can be moved to a sheet feeding position.

The sheet feeding mechanism 32 is configured to separate each one of the sheets S from the remaining sheets S placed on the sheet cassette 30, and to convey the each separated sheet S toward the conveying roller 33*a*. The sheet feeding mechanism 32 includes: a pick-up roller 32*a*; a separation roller 32*b*; and a separation pad 32*c*.

The pick-up roller 32*a* is a roller configured to pick-up the sheets S lifted to the sheet feeding position by the liter plate 31. The pick-up roller 32*a* is positioned above a front end portion of the lifter plate 31.

The separation roller 32*b* is positioned downstream relative to the pick-up roller 32*a* in the conveying direction. The separation pad 32*c* is disposed in confrontation with the separation roller 32*b* and urged toward the separation roller 32*b*.

The sheets S picked-up by the pick-up roller 32*a* are conveyed toward the separation roller 32*b*. The separation roller 32*b* separates each one of the sheets S from the remaining sheets S in cooperation with the separation pad 32*c* at a position between the separation roller 32*b* and the separation pad 32*c*.

The conveying path L1 is a passageway through which the sheet S is conveyed by the conveying unit 6. The conveying path L1 is formed in the main casing 2, leading from the sheet cassette 30 to the discharge unit 8 via the image forming unit 5. The separated sheet S by the separation roller 32*b* and the separation pad 32*c* is conveyed to the conveying roller 33*a* along the conveying path L1.

The conveying roller 33*a* is configured to impart a conveying force to the sheet S. The conveying roller 33*a* is positioned downstream relative to the sheet feeding mechanism 32 in the conveying direction. A paper-dust removing roller 33*b* is disposed in confrontation with the conveying roller 33*a*. The sheet S conveyed toward the conveying roller 33*a* from the sheet feeding mechanism 32 is nipped between the conveying roller 33*a* and the paper-dust removing roller 33*b*, and is further conveyed toward the registration roller 34 along the conveying path L1.

The registration roller 34 is positioned downstream relative to the conveying roller 33*a* in the conveying direction. An opposing roller 35 is disposed in confrontation with the registration roller 34. The registration roller 34 is configured to correct the orientation of the sheet S in cooperation with the opposing roller 35. Specifically, movement of a leading edge of the conveyed sheet S is regulated and temporarily stopped by the registration roller 34 and the opposing roller 35 to correct the orientation of the sheet S. After the orientation of the sheet S is corrected, the registration roller 34 conveys the sheet S toward an image transfer position at a prescribed timing.

A pre-registration sensor S1 is positioned upstream relative to the registration roller 34 in the conveying direction, and a post-registration sensor S2 is positioned downstream relative to the registration roller 34 in the conveying direction.

The pre-registration sensor S1 and the post-registration sensor S2 are sensors for detecting whether the sheet S is present at their respective positions.

When the leading edge of the sheet S conveyed along the conveying path L1 reaches the pre-registration sensor S1, the pre-registration sensor S1 is rendered ON for detection of the sheet S. Similarly, when the leading edge of the sheet S conveyed along the L1 reaches the post-registration sensor S2, the post-registration sensor S2 is rendered ON for detection of the sheet S.

When a trailing edge of the sheet S conveyed along the conveying path L1 reaches the pre-registration sensor S1, the pre-registration sensor S1 is rendered OFF, halting the detection of the sheet S. Similarly, when the trailing edge of the sheet S conveyed along the conveying path L1 reaches the post-registration sensor S2, the post-registration sensor S2 is rendered OFF, halting the detection of the sheet S.

The registration roller 34 starts rotating when a prescribed time has elapsed after the leading edge of the sheet S conveyed along the conveying path L1 reaches the pre-registration sensor S1 and the pre-registration sensor S1 is rendered ON. The registration roller 34 stops rotating when a prescribed time has elapsed after the trailing edge of the sheet S conveyed along the conveying path L1 reaches the post-registration sensor S2 and the post-registration sensor S2 is rendered OFF.

The image forming unit 5 includes: a process cartridge 50; an exposure unit 60; and a fixing unit 70. The process cartridge 50 is configured to transfer an image onto a surface of the sheet S conveyed from the sheet supply unit 3. The exposure unit 60 is configured to expose a surface of a photosensitive drum 54 of the process cartridge 50 to light. The fixing unit 70 is configured to fix the transferred image onto the sheet S.

The process cartridge 50 is positioned within the main casing 2 at a position above the sheet supply unit 3. The process cartridge 50 includes: a developer chamber 51; a supply roller 52; a developing roller 53; the photosensitive drum 54; and a transfer roller 55.

The exposure unit 60 includes: a laser diode; a polygon mirror; lenses; and reflection mirrors. The exposure unit 60 is configured to emit a laser beam to expose the surface of the photosensitive drum 54 to light based on image data inputted into the image forming apparatus 1.

The developer chamber 51 accommodates therein toner as developer. The toner accommodated in the developer chamber 51 is supplied to the supply roller 52 while agitated by an agitation member (not illustrated). The supply roller 52 is configured to supply the toner supplied from the developer chamber 51 to the developing roller 53.

The developing roller 53 is disposed in contact with the supply roller 52. The developing roller 53 is configured to carry the toner supplied from the supply roller 52. A friction member (not illustrated) is provided for charging the toner carried on the developing roller 53 with positive polarity. The developing roller 53 is applied with a developing bias having positive polarity by a bias application unit (not illustrated).

The photosensitive drum 54 is positioned adjacent to the developing roller 53. The surface of the photosensitive drum 54 is exposed to light by the exposure unit 60 after the surface of the photosensitive drum 54 is uniformly charged with positive polarity by a charger (not illustrated). The exposed region of the photosensitive drum 54 has an electric potential lower than that of the non-exposed region. Thus, an electrostatic latent image based on image data is formed on the photosensitive drum 54.

Then, the positively charged toner is supplied to the surface of the photosensitive drum 54 from the developing roller 53, so that the electrostatic latent image becomes a visible developer image.

The transfer roller 55 is disposed in confrontation with the photosensitive drum 54. The transfer roller 55 is applied with a transfer bias having negative polarity by the bias application unit (not illustrated). The developer image carried on the surface of the photosensitive drum 54 is transferred onto the surface of the sheet S when the sheet S is nipped and conveyed through the image transfer position between the photosensitive drum 54 and the transfer roller 55 while the transfer bias is applied to the surface of the transfer roller 55.

The fixing unit 70 includes a heating roller 71 and a pressure roller 72. The heating roller 71 is rotationally driven by the drive force from the motor 4 and heated by electric power supplied from a power supply unit (not illustrated). The pressure roller 72 is disposed in confrontation with the heating roller 71. The pressure roller 72 is in contact with the heating roller 71 and follows the rotation of the heating roller 71. The developer image carried on the sheet S is thermally fixed to the sheet S when the sheet S conveyed along the conveying path L1 is nipped and conveyed between the heating roller 71 and the pressure roller 72.

The discharge unit 8 includes the pair of switchback rollers 81, 81 and the discharge tray 82 for supporting the sheet S on which an image has been formed by the image forming unit 5.

The pair of switchback rollers 81, 81 is configured to discharge the sheet S conveyed from the fixing unit 70 along the conveying path L1 toward an outside of the main casing 2.

The discharge tray 82 is formed on an upper surface of the main casing 2. The sheet S discharged outside the main casing 2 by the switchback rollers 81, 81 is received on the discharge tray 82.

The switchback rollers 81, 81 are configured to be rotated in a normal direction in which the sheet S is conveyed toward the discharge tray 82, and in a reverse direction opposite to the normal direction. When the switchback rollers 81, 81 rotate in the reverse direction, the sheet S discharged from the fixing unit 70 is conveyed back toward the image forming unit 5.

That is, the switchback rollers 81, 81 are configured to rotate in a first mode for conveying the sheet S in a direction from the image forming unit 5 toward the discharge tray 82 (an example of a second direction), and in a second mode for conveying the sheet S in a direction from the discharge tray 82 toward the reconveying unit 7 (an example of a third direction).

The reconveying path L2 is a passageway through which the sheet S is conveyed by the reconveying unit 7. The reconveying path L2 is formed in the main casing 2 at a position below the image forming unit 5. When the switchback rollers 81, 81 are rotationally driven in the reverse direction at the second mode, the switchback rollers 81, 81 convey the sheet S back toward the image forming unit 5 along the reconveying path L2. The sheet S conveyed along the reconveying path L2 is conveyed further toward the image forming unit 5 by the reconveying rollers 36, 36 provided at the reconveying unit 7. In the present embodiment, the reconveying unit 7 includes two pairs of reconveying rollers 36, 36.

The reconveying path L2 branches from the conveying path L1 at a position between the fixing unit 70 and the discharge tray 82, and rejoins the conveying path L1 at a position between the sheet cassette 30 and the registration roller 34. The position where the reconveying path L2 branches from the conveying path L1 will be referred to as a branch portion L3, while the position where the reconveying path L2 rejoins the conveying path L1 will be referred to as a rejoining portion L4.

The reconveying path L2 is positioned below the image forming unit 5. The reconveying path L2 includes: a reconveying portion L2*a*; a first curved portion L2*b*; and a second curved portion L2*c* as an example of a curved portion. The reconveying rollers 36, 36 are disposed at the reconveying portion L2*a*. The first curved portion L2*b* is curved-shaped and extends between the branch portion L3 and the reconveying portion L2*a*. The second curved portion L2*c* is curved-shaped and extends between the reconveying portion L2*a* and the rejoining portion L4.

The image forming apparatus 1 further includes a chute member 15 defining at least a part of the conveying path L1 and at least a part of the reconveying path L2. More specifically, the chute member 15 has a guide surface 15*a* forming an inner peripheral surface of the second curved portion L2*c* and guiding the sheet S conveyed along the second curved portion L2*c*.

The image forming apparatus 1 can perform an image-forming operation at a duplex printing mode. At the duplex printing mode, an image is formed on one side of a sheet S at the image forming unit 5, and the sheet S discharged from the fixing unit 70 is reconveyed toward the image forming unit 5 along the reconveying path L2, and another image is formed on the other side of the sheet S at the image forming unit 5.

The registration roller 34 and other rollers constituting the conveying unit 6 are rotationally driven by the drive force supplied from the motor 4 through the first transmission mechanism 11.

When the motor 4 rotates in a normal direction as an example of a first rotational direction, the first transmission mechanism 11 transmits the drive force from the motor 4 to the registration rollers 34 and other rollers such that these rollers are rotated in a rotating direction for conveying the sheet S toward the discharge unit 8. When the motor 4 rotates in a reverse direction as an example of a second rotational direction, the first transmission mechanism 11 does not transmit the drive force from the motor 4 to the registration rollers 34 and other rollers.

The switchback rollers 81, 81 are rotationally driven by the drive force from the motor 4 through the third transmission mechanism 12.

When the motor 4 rotates in the normal direction, the third transmission mechanism 12 transmits the drive force from the motor 4 to the switchback rollers 81, 81 to rotate the switchback rollers 81, 81 at the first mode. When the motor 4 rotates in the reverse direction, the third transmission mechanism 12 transmits the drive force from the motor 4 to the switchback rollers 81, 81 to rotate the switchback rollers 81, 81 at the second mode.

The reconveying unit 7 includes the reconveying rollers 36, 36. The reconveying rollers 36, 36 are rotationally driven by the drive force from the motor 4 through the second transmission mechanism 20. That is, the reconveying rollers 36, 36 are configured to rotate in a reconveying mode for conveying the sheet S in a reconveying direction from the branch portion L3 toward the rejoining point L4 (an example of a first direction). The reconveying rollers 36, 36 are an example of a roller.

The second transmission mechanism 20 is configured to operate in a first transmission mode and at a second transmission mode. At the first transmission mode, the second transmission mechanism 20 transmits the rotational drive force supplied from the motor 4 to the reconveying rollers 36, 36 without reversing the direction of the rotational drive force. At the second transmission mode, the second transmission mechanism 20 reverses the direction of the rotational drive force supplied from the motor 4 and transmits the reversed force to the reconveying rollers 36, 36.

More specifically, when the motor 4 rotates in the reverse direction, the second transmission mechanism 20 operates at the first transmission mode. The second transmission mechanism 20 in the first transmission mode outputs the drive force received from the motor 4 to the reconveying rollers 36, 36 without reversing the rotational direction of the drive force. Thus, the second transmission mechanism 20 in the first transmission mode transmits the drive force to the reconveying rollers 36, 36 to rotate the reconveying rollers 36, 36 in the reconveying mode for conveying the sheet S in the reconveying direction from the branch portion L3 toward the rejoining portion L4.

When the rotating direction of the motor 4 is switched from the reverse direction to the normal direction, the transmission mode of the second transmission mechanism 20 is switched from the first transmission mode to the second transmission mode. The second transmission mechanism 20 in the second transmission mode reverses the rotational direction of the drive force supplied from the motor 4 and outputs the reversed force to the reconveying rollers 36, 36. Thus, the second transmission mechanism 20 in the second transmission mode transmits the drive force to the reconveying rollers 36, 36 to rotate the reconveying rollers 36, 36 in the reconveying mode for conveying the sheet S in the reconveying direction from the branch portion L3 toward the rejoining portion L4.

The second transmission mechanism 20 starts operating in the second transmission mode when the rotating direction of the motor 4 is switched from the reverse direction to the normal direction, and continues to operate in the second transmission mode until the reconveying rollers 36, 36 rotate by the predetermined number of rotations, and then, interrupts transmission of the drive force to the reconveying rollers 36, 36.

That is, the second transmission mechanism 20 is configured to transmit the drive force from the motor 4 to the reconveying rollers 36, 36 to rotate the reconveying rollers 36, 36, by the predetermined number of rotations, in the reconveying mode for conveying the sheet S in the reconveying direction from the branch portion L3 toward the rejoining portion L4 after the rotational direction of the drive force from the motor 4 is switched from the reverse direction to the normal direction, and then, to interrupt transmission of the drive force to the reconveying rollers 36, 36.

In this way, the motor 4 supplies the drive force for conveying the sheet S to the conveying unit 6, the switchback rollers 81, 81, and the reconveying unit 7 including the reconveying rollers 36, 36.

The image forming apparatus 1 further includes a controller 41 for controlling the rotation of the motor 4 in the normal direction and in the reverse direction, and stop of the rotation of the motor 4.

<Configuration of Second Transmission Mechanism>

Next, a configuration of the second transmission mechanism 20 will be described in detail.

Figure 2:
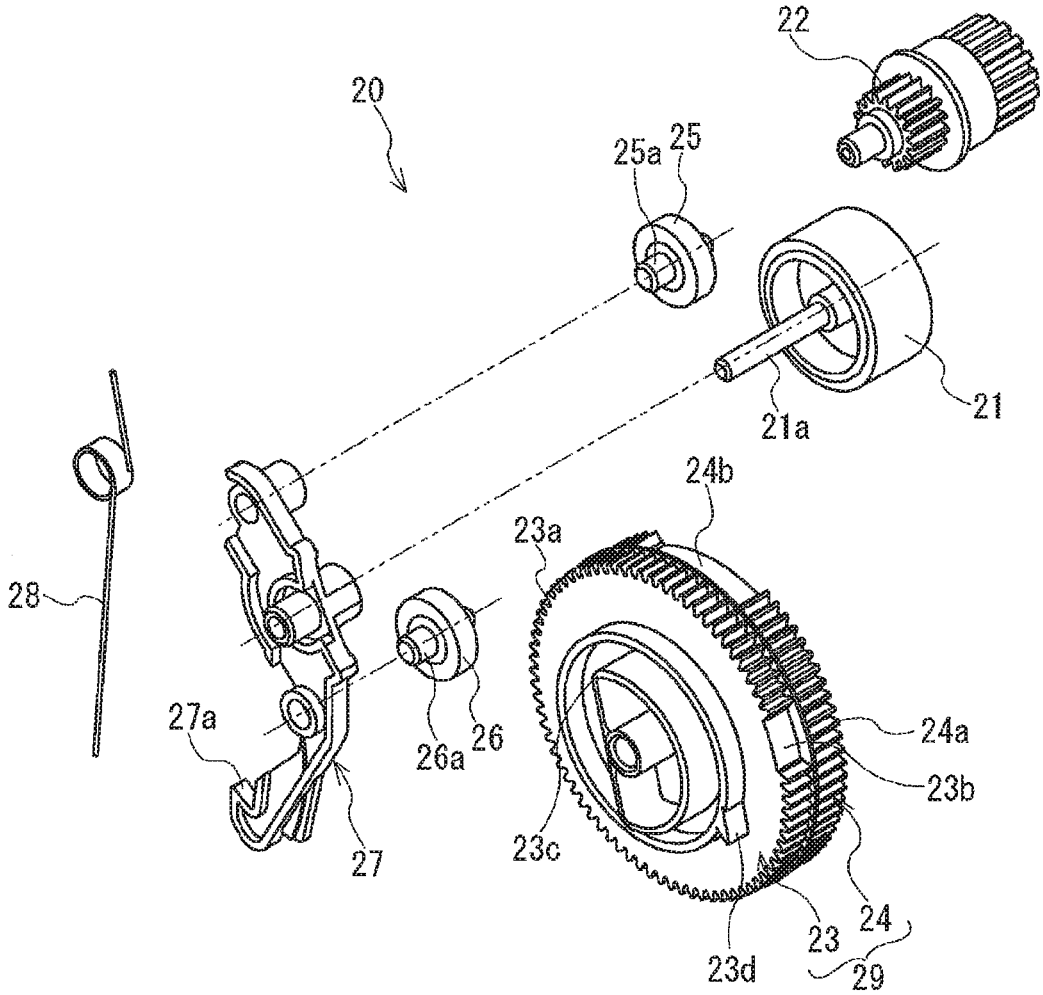
FIG. 2 is an exploded perspective view of a second transmission mechanism according to the first embodiment.
Figure 3A:
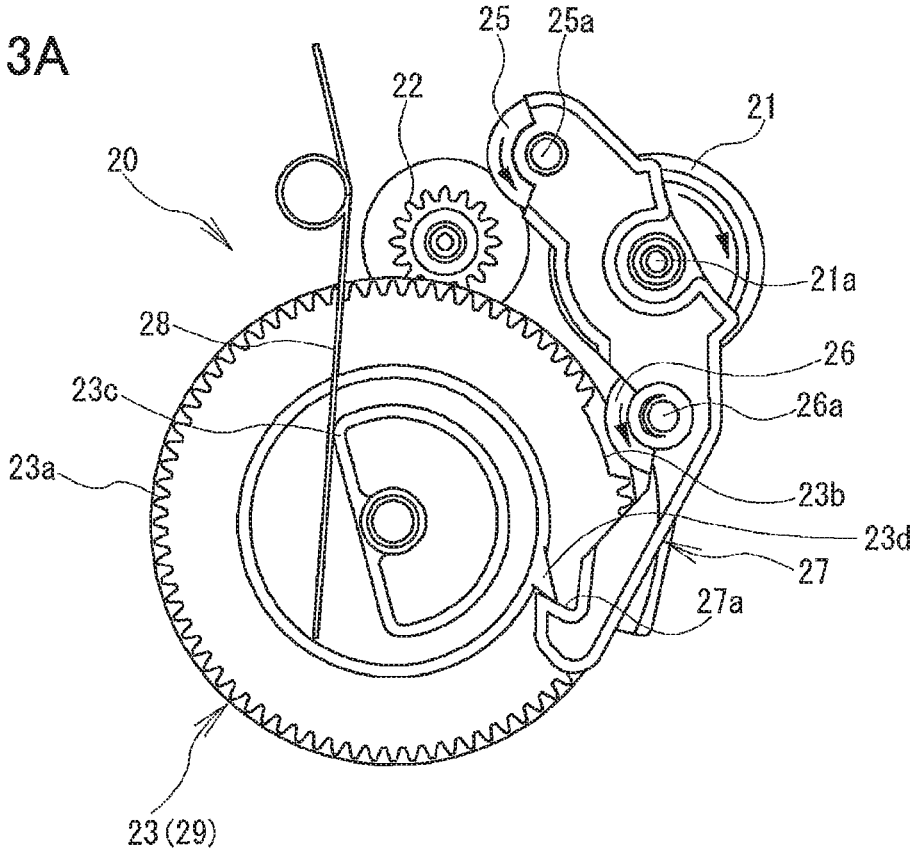
FIGS. 3A and 3B are side views of the second transmission mechanism according to the first embodiment when a motor is rotated in a normal direction, in which FIG. 3A particularly illustrates a relationship between an output gear and a first swinging gear and a relationship between a second gear and a second swinging gear.
Figure 3B:
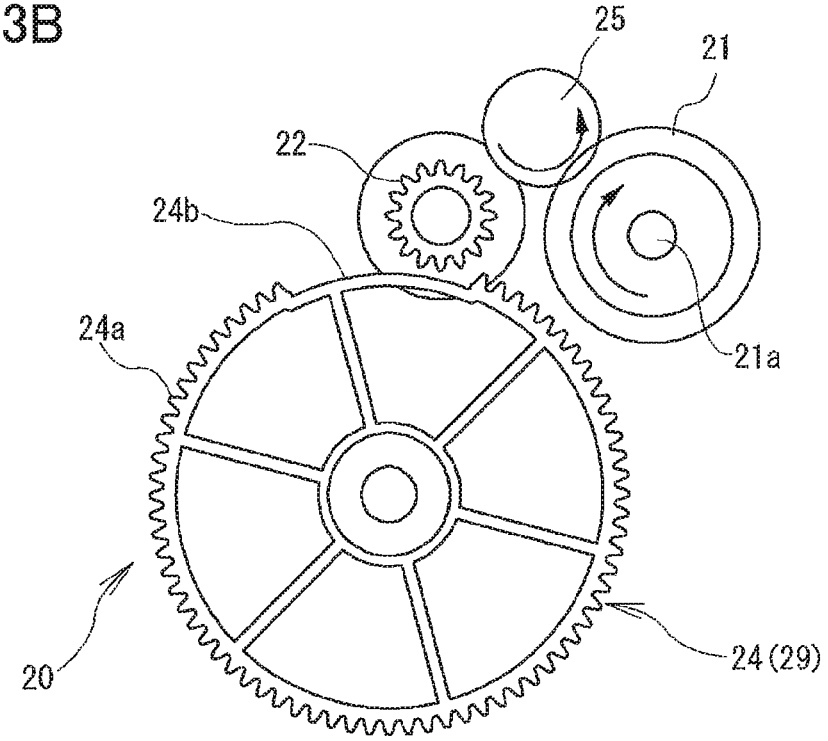

As illustrated in FIGS. 2, 3A and 3B, the second transmission mechanism 20 includes: an input gear 21; an output gear 22; an intermediate gear 29 including a first gear 24 and a second gear 23; a first swinging gear 25; a second swinging gear 26; a revolving member 27; a resilient member 28 (an example of an urging member); and a locking mechanism.

The input gear 21 is configured to rotate upon receipt of the drive force supplied from the motor 4. The output gear 22 is configured to output the drive force to the reconveying rollers 36, 36. The first gear 24 and the second gear 23 can rotate coaxially and integrally with each other. The first gear 24 is capable of meshing with the output gear 22. The first swinging gear 25 meshes with the input gear 21. The second swinging gear 26 meshes with the input gear 21. The revolving member 27 supports the first swinging gear 25 and the second swinging gear 26, and is configured to revolve about an axis of a rotation shaft 21*a* of the input gear 21. The resilient member 28 is configured to urge the intermediate gear 29 in a rotating direction of the intermediate gear 29. The locking mechanism configured to lock the rotation of the intermediate gear 29 at a predetermined rotation position.

More specifically, the input gear 21 receives the drive force supplied from the motor 4 to thereby be rotated in a rotating direction according to the rotating direction of the motor 4. The revolving member 27 is supported to the rotation shaft 21*a* of the input gear 21 so as to revolve about the axis of the rotation shaft 21*a*.

Incidentally, the input gear 21 may not have the rotation shaft 21*a*, the revolving member 27 may have a pivot shaft, and the input gear 21 may be supported by the pivot shaft as long as the revolving member 27 can revolve about the rotation axis of the input gear 21.

The second gear 23 has a second toothed part 23*a* having gear teeth, and a second toothless part 23*b* having no gear teeth. The second toothless part 23*b* having no gear teeth is formed on a part of an outer peripheral surface of the second gear 23. The second toothed part 23*a* having gear teeth is formed on a remaining part of the outer peripheral surface of the second gear 23. The second gear 23 further has a cam part 23*c* and an engagement part 23*d*. The cam part 23*c* is rib-shaped having an arcuate portion and a linear portion. The arcuate portion is formed into an arcuate shape centered on a rotational axis of the second gear 23. The linear portion connects both ends of the arcuate portion.

The first gear 24 has a first toothed part 24*a* and a first toothless part 24*b*. The first toothed part 24*a* has gear teeth and is capable of meshing with the output gear 22. The first toothless part 24*b* has no gear teeth. The first toothless part 24*b* having no gear teeth is formed on a part of an outer peripheral surface of the first gear 24. The first toothed part 24*a* having gear teeth is formed on a remaining part of the outer peripheral surface of the first gear 24.

The second gear 23 and the first gear 24 are arranged coaxially with each other, and are configured so as to be rotatable integrally with each other as the intermediate gear 29. That is, the second gear 23 and the first gear 24 constitute the intermediate gear 29.

The revolving member 27 is configured to revolve by the drive force transmitted from the motor 4 to the input gear 21 as a revolving force. That is, the revolving member 27 can revolve in the rotating direction of the input gear 21 by a friction force generated between the input gear 21 and the revolving member 27 when the input gear 21 is rotated by the drive force from the motor 4.

The revolving member 27 supports the first swinging gear 25 and the second swinging gear 26 such that the first swinging gear 25 can rotate about an axis of a rotational shaft 25*a* of the first swinging gear 25 and the second swinging gear 26 can rotate about an axis of a rotational shaft 26*a* of the second swinging gear 26.

Incidentally, the first planetary gear 25 and the second planetary gear 26 may not have the rotational shaft 25*a* and the rotational shaft 26*a*, respectively, and the revolving member 27 may have shaft portions at which the first planetary gear 25 and the second planetary gear 26 are rotatably supported.

The revolving member 27 revolves or pivotally moves about the axis of the rotation shaft 21*a*, so that the first swinging gear 25 and the second swinging gear 26 can swingably move about the axis of the rotation shaft 21*a* while the first swinging gear 25 and the second swinging gear 26 mesh with the input gear 21.

That is, the revolving member 27 supports the first swinging gear 25 and the second swinging gear 26 such that the first swinging gear 25 and the second swinging gear 26 can swingably move about the axis of the rotation shaft 21*a* of the input gear 21 while meshing with the input gear 21.

Figure 4A:
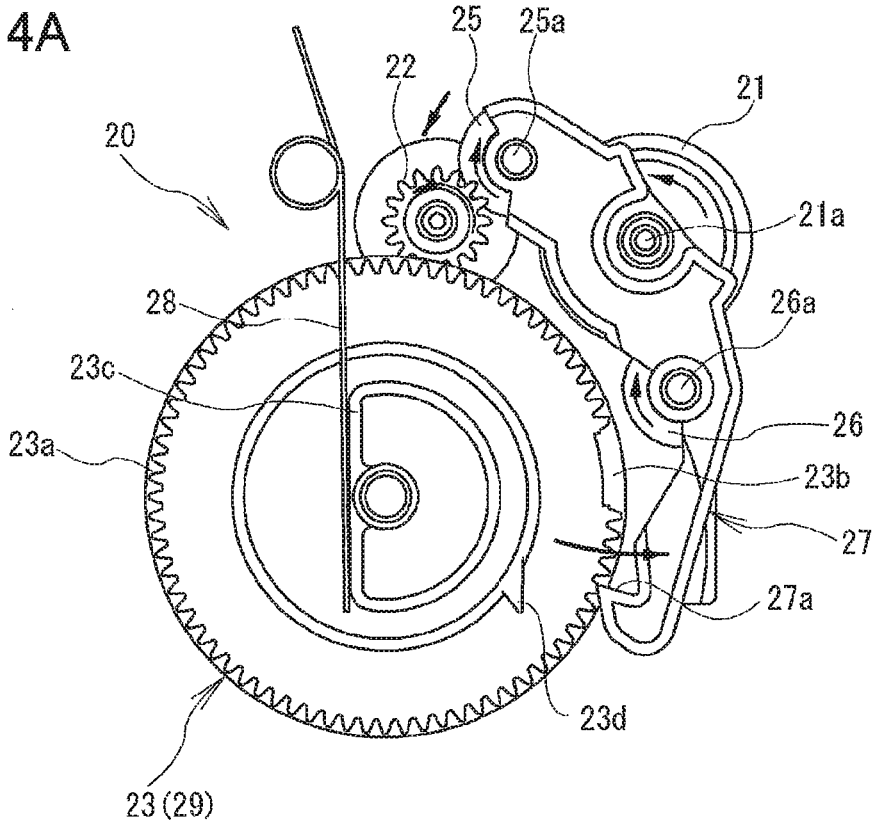
FIGS. 4A and 4B are side views of the second transmission mechanism according to the first embodiment when the motor is rotated in a reverse direction, in which FIG. 4A particularly illustrates the relationship between the output gear and the first swinging gear and the relationship between the second gear and the second swinging gear.
Figure 4B:
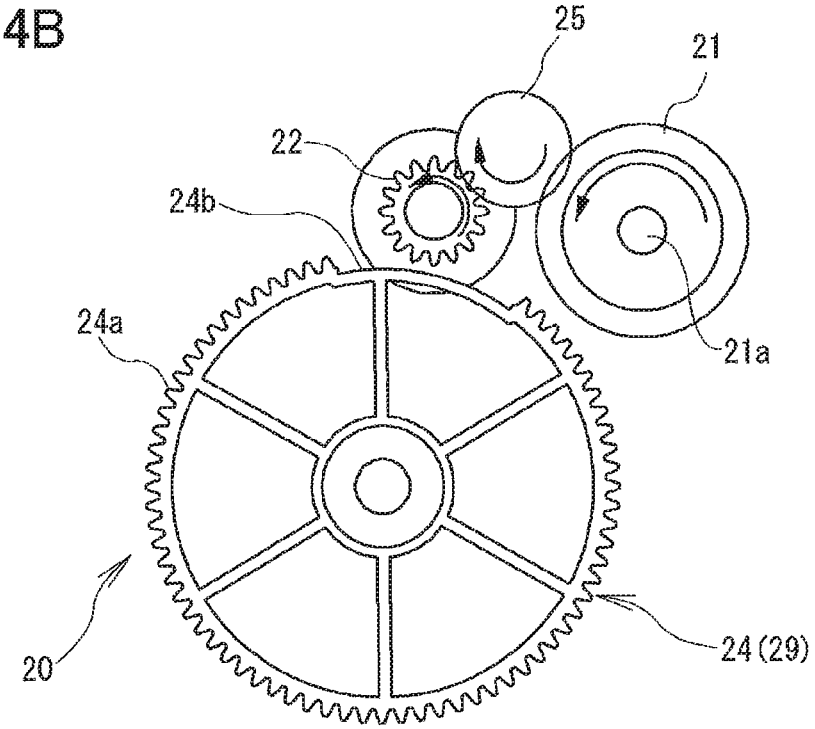

The revolving member 27 is configured to revolve between a first revolving position (a revolving position of the revolving member 27 illustrated in FIGS. 4A and 4B) where the first swinging gear 25 meshes with the output gear 22 and the second swinging gear 26 is separated from the second gear 23 and a second revolving position (a revolving position of the revolving member 27 illustrated in FIGS. 3A and 3B) where the second swinging gear 26 is capable of meshing with the second gear 23 and the first swinging gear 25 is separated from the output gear 22.

The revolving member 27 moves to the first revolving position when the motor 4 supplies the drive force in the reverse direction, while the revolving member 27 moves to the second revolving position when the motor 4 supplies the drive force in the normal direction.

Hereinafter, the first swinging gear 25 when the revolving member 27 is located at the first revolving position (i.e., the first swinging gear 25 located at a position meshing with the output gear 22) will also be referred to as "the first swinging gear 25 at the first revolving position". Similarly, the second swinging gear 26 when the revolving member 27 is located at the first revolving position (i.e., the second swinging gear 26 located at a position separated from the second gear 23) will also be referred to as "the second swinging gear 26 at the first revolving position".

Further, the first swinging gear 25 when the revolving member 27 is located at the second revolving position (i.e., the first swinging gear 25 located at a position separated from the output gear 22) will also be referred to as "the first swinging gear 25 at the second revolving position". Similarly, the second swinging gear 26 when the revolving member 27 is located at the second revolving position (i.e., the second swinging gear 26 located at a position capable of meshing with the second gear 23) will also be referred to as "the second swinging gear 26 at the second revolving position".

When the second gear 23 is located at a rotation position where the second toothed part 23*a* confronts the second swinging gear 26 while the revolving member 27 is located at the second revolving position, the second swinging gear 26 meshes with the second toothed part 23*a*. This allows a rotation force of the second swinging gear 26 to be transmitted to the second gear 23.

On the other hand, when the second gear 23 is located at a rotation position where the second toothless part 23*b* confronts the second swinging gear 26 while the revolving member 27 is located at the second revolving position, the second swinging gear 26 does not mesh with the second toothed part 23*a*. Hence, the rotation force of the second swinging gear 26 is not transmitted to the second gear 23.

When the revolving member 27 is located at the second revolving position, the first swinging gear 25 is separated from the output gear 22. Hence, the first swinging gear 25 does not mesh with the output gear 22. Accordingly, a rotation force of the first swinging gear 25 is not transmitted to the output gear 22.

When the revolving member 27 is located at the first revolving position, the first swinging gear 25 meshes with the output gear 22. This allows the rotation force of the first swinging gear 25 to be transmitted to the output gear 22.

Further, when the revolving member 27 is located at the first revolving position, the second swinging gear 26 is separated from the second gear 23. Hence, the second swinging gear 26 does not mesh with the second toothed part 23*a* regardless of the rotation position of the second gear 23. Accordingly, the rotation force of the second swinging gear 26 is not transmitted to the second gear 23.

When the intermediate gear 29 is located at a rotation position where the second toothless part 23*b* confronts the second swinging gear 26 at the second revolving position, the first toothless part 24*b* is located at a position confronting the output gear 22.

When the intermediate gear 29 is located at a rotation position where the first toothed part 24*a* confronts the output gear 22, the output gear 22 meshes with the first toothed part 24*a*. This allows a rotation force of the first gear 24 to be transmitted to the output gear 22.

When the intermediate gear 29 is located at a rotation position where the first toothless part 24*b* confronts the output gear 22, the output gear 22 does not mesh with the first toothed part 24*a*. Hence, the rotation force of the first gear 24 is not transmitted to the output gear 22.

The resilient member 28 provided at the second transmission mechanism 20 urges the cam part 23*c* of the second gear 23. In the present embodiment, the resilient member 28 is formed of a torsion coil spring.

The resilient member 28 abuts against a boundary between the arcuate portion and the linear portion in the cam part 23*c* to urge the cam part 23*c*. Hence, the second gear 23 and the first gear 24 (i.e., intermediate gear 29) are rotated by the urging force of the resilient member 28.

Specifically, the resilient member 28 is configured to abut against the boundary between the arcuate portion and the liner portion in the cam part 23*c* when at least the intermediate gear 29 is located at the rotation position where the second toothless part 23*b* confronts the second swinging gear 26 at the second revolving position. As the cam part 23*c* is urged by the resilient member 28 abutting against the boundary, the intermediate gear 29 at this rotation position can be rotated to a rotation position where the second toothed part 23*a* confronts the second swinging gear 26 at the second revolving position.

The revolving member 27 has an engaging part 27*a* engageable with the engagement part 23*d* of the second gear 23. When the revolving member 27 is located at the second revolving position, the engaging part 27*a* is located at a lock position where the engaging part 27*a* is in engagement with the engagement part 23*d*. When the revolving member 27 is located at the first revolving position, the engaging part 27*a* is located at a lock release position where the engaging part 27*a* is out of engagement with the engagement part 23*d*.

When the engaging part 27*a* is located at the lock position, the intermediate gear 29 is restricted from rotating. Hence, in a state where the resilient member 28 abuts against the cam part 23*c* to urge the intermediate gear 29 in the rotating direction thereof, the intermediate gear 29 is maintained at a rotation position where the second toothless part 23*b* confronts the second swinging gear 26 at the second revolving position.

When the engaging part 27*a* is located at the lock release position, the intermediate gear 29 is urged in the rotating direction thereof by the urging force of the resilient member 28. This allows the intermediate gear 29 to be rotated to a rotation position where the second swinging gear 26 at the second revolving position meshes with the second toothed part 23*a*.

In this way, when the engaging part 27*a* is located at the lock position, the locking mechanism of the second transmission mechanism 20 locks the rotation of the intermediate gear 29 urged by the resilient member 28 at the rotation position where the second toothless part 23*b* confronts the second swinging gear 26, and maintains the intermediate gear 29 at the rotation position where the second toothless part 23*b* confronts the second swinging gear 26. Further, when the engaging part 27*a* is located at the lock release position, the locking mechanism allows the intermediate gear 29 urged by the resilient member 28 to be rotated to the rotation position where the second swinging gear 26 meshes with the second toothed part 23*a* in response to the movement of the revolving member 27 to the second revolving position.

The engagement part 23*d* of the second gear 23 and the engaging part 27*a* of the revolving member 27 constitute the locking mechanism.

<Operation of Second Transmission Mechanism>

Next, an operation of the second transmission mechanism 20 having the configuration described above will be described.

Figure 8A:
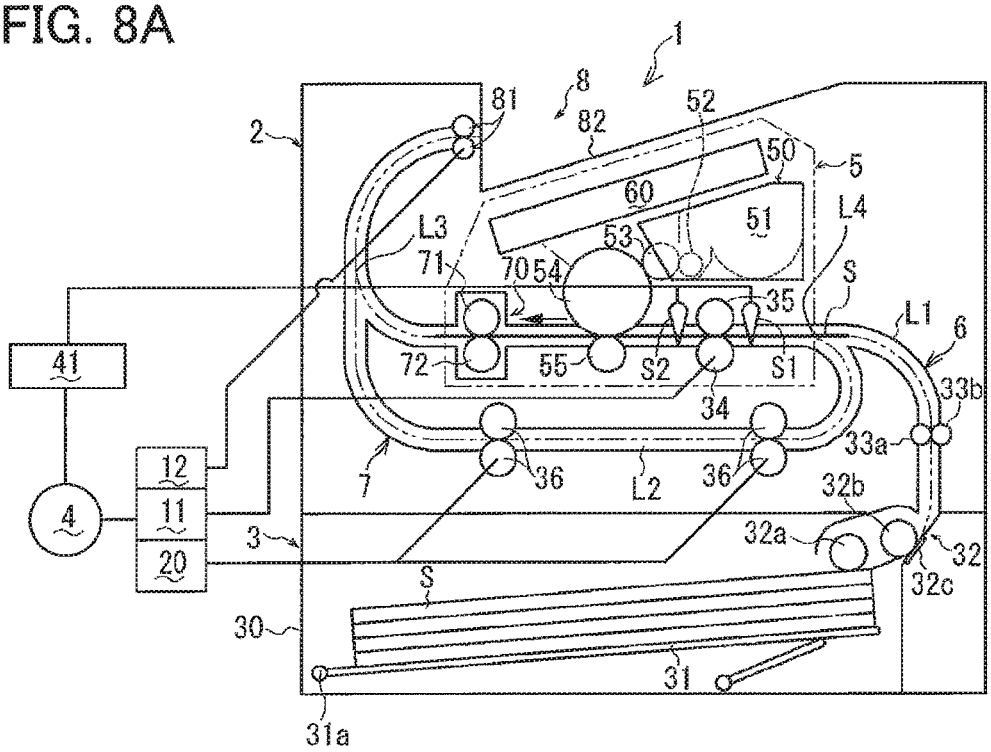
FIG. 8A is a schematic center cross-sectional view of the image forming apparatus according to the first embodiment, illustrating a state where a sheet is conveyed through an image forming unit toward a discharge tray in the image forming apparatus.

First, as illustrated in FIG. 8A, when the motor 4 is rotated in the normal direction under the control of the controller 41, the drive force is transmitted from the motor 4 to the registration roller 34 and other rollers constituting the conveying unit 6 to convey the sheet S in the image forming unit 5 toward the discharge unit 8. At this time, as illustrated in FIGS. 3A and 3B, in the second transmission mechanism 20, the input gear 21 is rotated in the normal direction (clockwise direction in FIGS. 3A and 3B) while receiving the drive force from the motor 4 rotating in the normal direction.

When the input gear 21 is rotated in the normal direction (an example of a second rotating direction), the revolving member 27 revolves in the same direction as the rotating direction of the input gear 21 to be moved to the second revolving position.

In a state where the revolving member 27 is located at the second revolving position, the second swinging gear 26 is located at a position capable of meshing with the second gear 23, and the first swinging gear 25 is separated from the output gear 22. Further, in this state, the engaging part 27*a* is located at the lock position where the engaging part 27*a* is in engagement with the engagement part 23*d*. Thus, the second gear 23 is maintained at the rotation position where the second toothless part 23*b* confronts the second swinging gear 26 at the second revolving position, while being urged by the resilient member 28 in the rotating direction of the second gear 23.

In this state, the rotational drive force inputted into the input gear 21 is not transmitted to the output gear 22 through the first swinging gear 25 since the first swinging gear 25 is separated from the output gear 22.

Further, since the second toothless part 23*b* is located at a position confronting the second swinging gear 26, the second swinging gear 26 does not mesh with the second gear 23. Hence, the drive force inputted into the input gear 21 is not transmitted to the second gear 23 through the second swinging gear 26. Accordingly, the rotational drive force inputted into the input gear 21 is not transmitted to the output gear 22 through the second gear 23 and the first gear 24.

In this way, in a state where the engaging part 27*a* is located at the lock position to be engaged with the engagement part 23*d* and the input gear 21 is rotated in the normal direction, the rotation force of the input gear 21 is not transmitted to the output gear 22. Thus, the reconveying rollers 36, 36 are not rotated.

Accordingly, when the sheet S is conveyed in the image forming unit 5 toward the discharge unit 8 while the drive force from the motor 4 is transmitted to the conveying unit 6 but the sheet S is not conveyed by the reconveying rollers 36, 36, rotation of the reconveying rollers 36, 36 is halted.

Figure 8B:
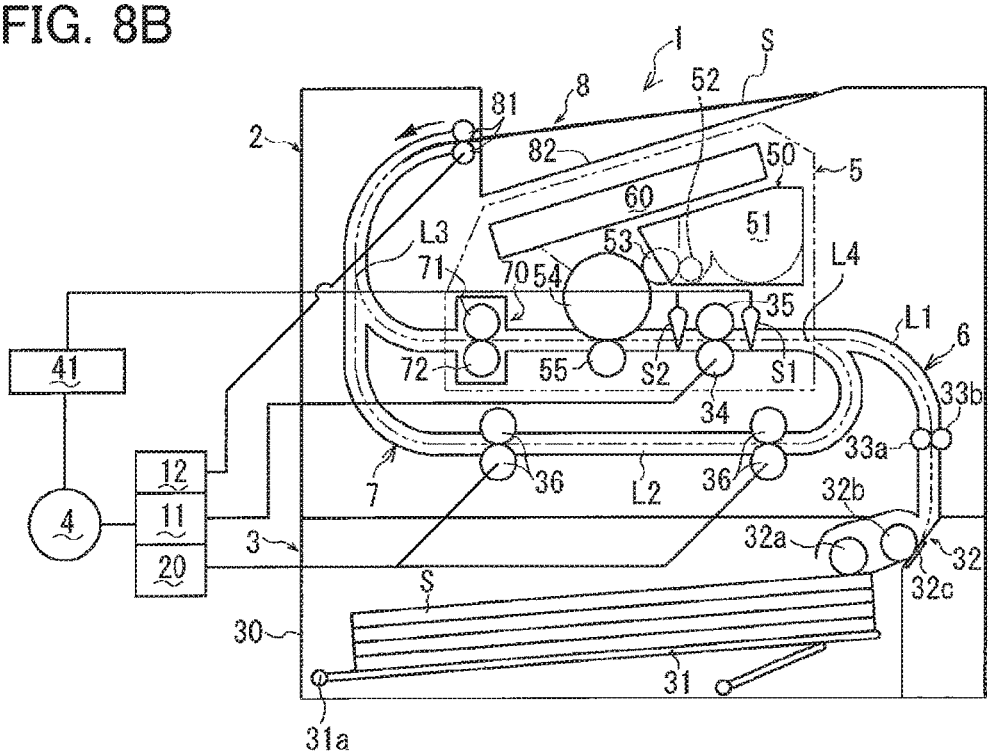
FIG. 8B is a schematic center cross-sectional view of the image forming apparatus according to the first embodiment, illustrating a state where the sheet that has been conveyed toward the discharge tray by switchback rollers is then conveyed toward a reconveying unit.

Next, as illustrated in FIG. 8B, the sheet S conveyed in the image forming unit 5 by the conveying unit 6 is discharged from the image forming unit 5, and the sheet S discharged from the image forming unit 5 is then conveyed toward the discharge tray 82 by the switchback rollers 81, 81. After the switchback rollers 81, 81 convey the sheet S toward the discharge tray 82, the rotating direction of the motor 4 is switched from the normal direction to the reverse direction under the control of the controller 41. This causes the switchback rollers 81, 81 to reconvey the sheet S toward the reconveying unit 7. At this time, as illustrated in FIGS. 4A and 4B, the rotating direction of the input gear 21 is switched from the normal direction to the reverse direction (counter-clockwise direction in FIGS. 4A and 4B) as the input gear 21 receives the drive force from the motor 4 rotating in the reverse direction.

Note that a timing at which the mode of the switchback rollers 81, 81 is switched from the first mode in which the sheet S is conveyed toward the discharge tray 82 to the second mode in which the sheet S is reconveyed toward the reconveying unit 7 can be set to a timing at which a predetermined time period has elapsed after the trailing edge of the sheet S conveyed by the conveying unit 6 along the conveying path L1 reaches the post-registration sensor S2 and the post-registration sensor S2 is rendered OFF.

When the rotating direction of the input gear 21 is switched to the reverse direction (an example of a first rotating direction), the revolving position of the revolving member 27 is switched from the second revolving position to the first revolving position. When the revolving member 27 is located at the first revolving position, the first swinging gear 25 meshes with the output gear 22, and the second swinging gear 26 is separated from the second gear 23. Hence, the rotational drive force inputted into the input gear 21 is transmitted to the output gear 22 through the first swinging gear 25. On the other hand, the second swinging gear 26 does not mesh with the second gear 23. Hence, the rotational drive force inputted into the input gear 21 is not transmitted to the second gear 23 through the second swinging gear 26.

When the rotational drive force inputted into the input gear 21 is transmitted to the output gear 22 through the first swinging gear 25, the output gear 22 is rotated in the reverse direction that is the same direction as the rotating direction of the input gear 21. When the output gear 22 is rotated in the reverse direction, the reconveying rollers 36, 36 are driven to rotate in the reconveying mode for conveying the sheet S in the reconveying direction from the branch portion L3 toward the rejoining portion L4 along the reconveying path L2.

In this way, when the motor 4 is rotated in the reverse direction, the second transmission mechanism 20 operates in the first transmission mode that outputs the rotational drive force inputted into the input gear 21 from the output gear 22 to the reconveying rollers 36, 36 without reversing the direction of the rotational drive force.

Figure 9A:
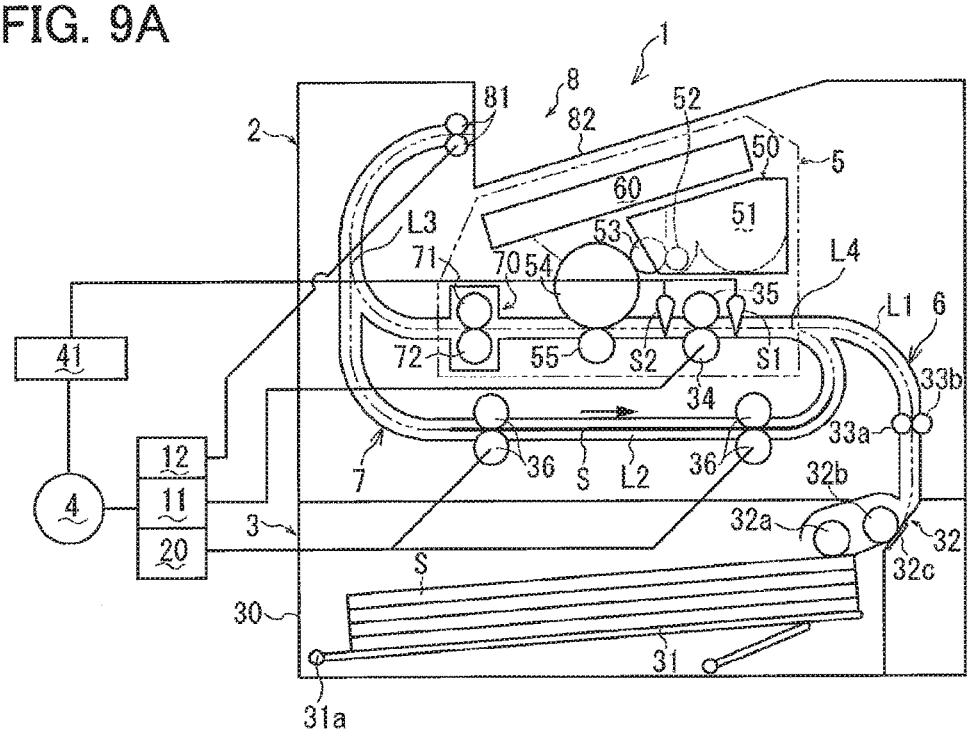
FIG. 9A is a schematic center cross-sectional view of the image forming apparatus according to the first embodiment, illustrating a state where the sheet is conveyed toward the image forming unit along the reconveying path by reconveying rollers.

After the reconveying rollers 36, 36 start rotating, the sheet S conveyed by the switchback rollers 81, 81 toward the reconveying unit 7 is received by the reconveying rollers 36, 36. As illustrated in FIG. 9A, the sheet S is conveyed by the reconveying rollers 36, 36 in the reconveying direction from the branch portion L3 toward the rejoining portion L4 along the reconveying path L2.

While the input gear 21 is rotated in the reverse direction, the revolving member 27 is located at the first revolving position, and the engaging part 27*a* is located at the lock release position. Thus, the engagement between the engaging part 27*a* and the engagement part 23*d* is released.

When the engagement between the engaging part 27*a* and the engagement part 23*d* is released, the intermediate gear 29 is rotated in the same direction (clockwise direction in FIGS. 4A and 4B) as the normal direction of the input gear 21 by the urging force of the resilient member 28. In this case, the intermediate gear 29 is rotated to the rotation position (an example of a third rotation position) where the second swinging gear 26 at the second revolving position meshes with the second toothed part 23*a*.

On the other hand, when the intermediate gear 29 is rotated from the rotation position where the second toothless part 23*b* is located at a position confronting the second swinging gear 26 to the rotation position where the second swinging gear 26 meshes with the second toothed part 23*a*, the first toothless part 24*b* of the first gear 24 is located at a position confronting the output gear 22. In other words, at this time, the output gear 22 is located at a position within the first toothless part 24*b*.

That is, the first toothless part 24*b* of the first gear 24 is formed such that the output gear 22 is located at a position within the first toothless part 24*b* while the intermediate gear 29 is located at the rotation position where the second toothless part 23*b* confronts the second swinging gear 26 and such that the output gear 22 remains to be located at the position within the first toothless part 24*b* even when the intermediate gear 29 is rotated from the rotation position where the second toothless part 23*b* confronts the second swinging gear 26 to the rotation position where the second toothed part 23*a* meshes with the second swinging gear 26.

In this way, when the intermediate gear 29 is rotated by the urging force of the resilient member 28 from the rotation position where the second toothless part 23*b* confronts the second swinging gear 26 to the rotation position where the second swinging gear 26 meshes with the second toothed part 23*a*, the first gear 24 does not mesh with the output gear 22. Thus, no load is applied from the output gear 22 to the intermediate gear 29 rotated by the urging force of the resilient member 28. Accordingly, even if the urging force of the resilient member 28 is small, the intermediate gear 29 can reliably be rotated to the rotation position where the second swinging gear 26 meshes with the second toothed part 23*a*.

Figure 5A:
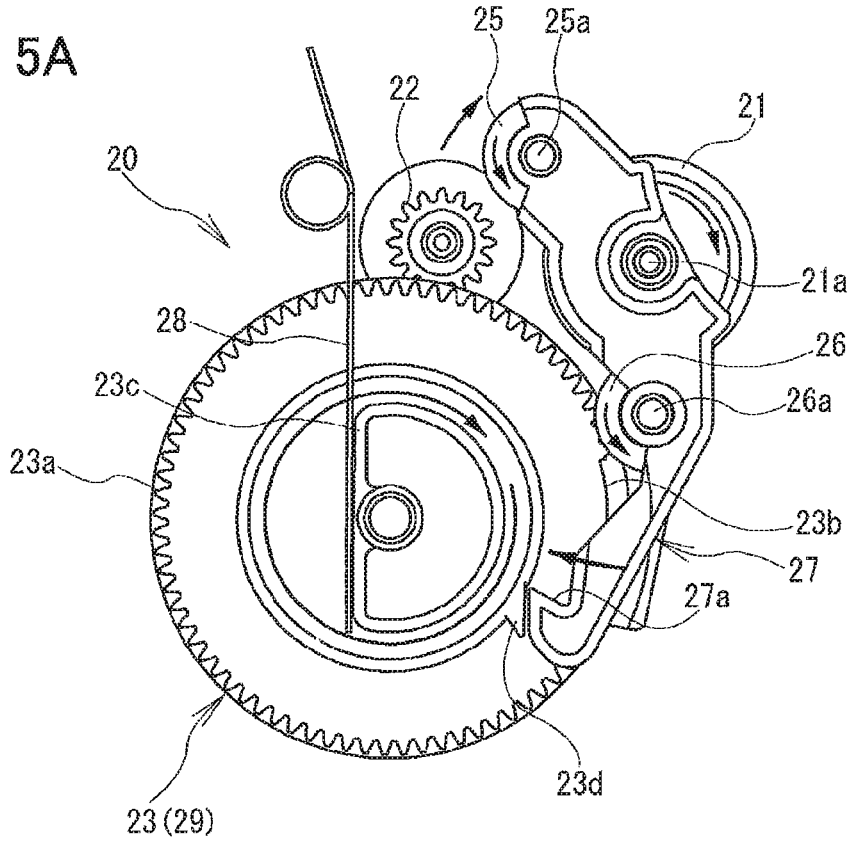
FIGS. 5A and 5B are side views of the second transmission mechanism according to the first embodiment when the rotating direction of the motor is switched from the reverse direction to the normal direction, in which FIG. 5A particularly illustrates the relationship between the output gear and the first swinging gear and the relationship between the second gear and the second swinging gear.
Figure 5B:
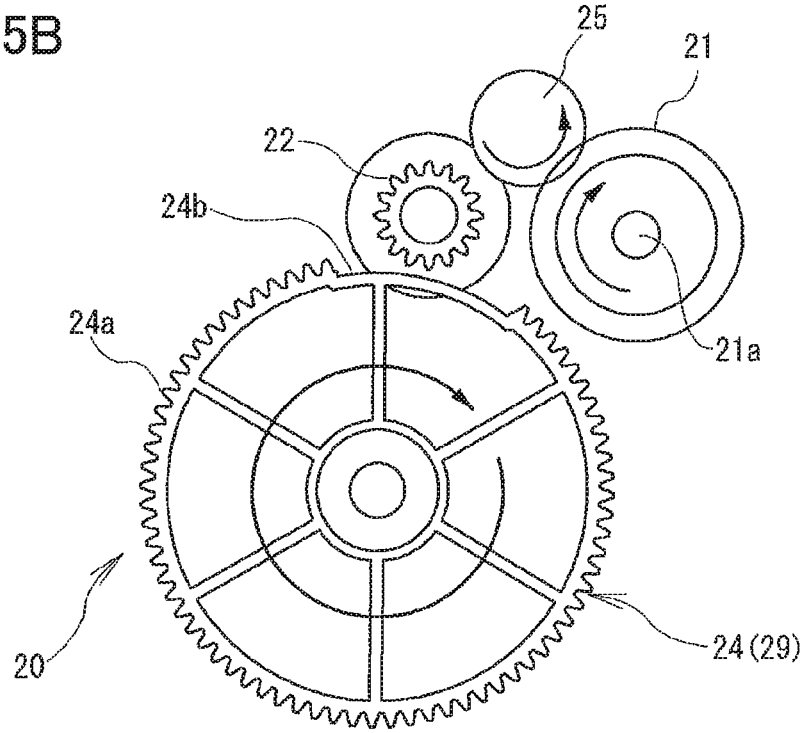
Figure 9B:
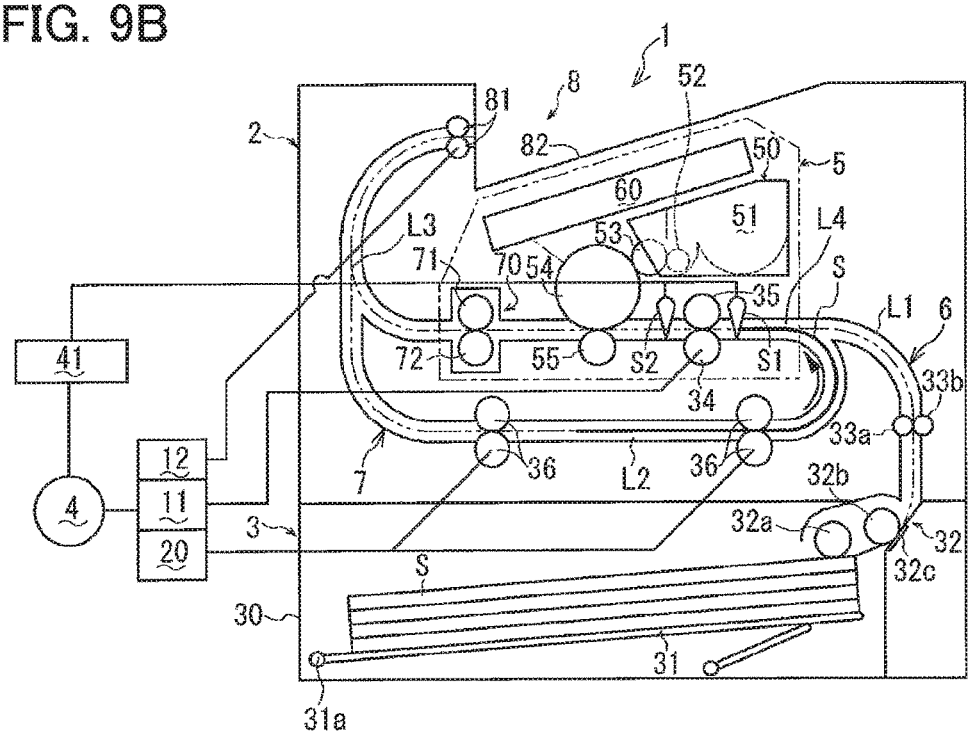
FIG. 9B is a schematic center cross-sectional view of the image forming apparatus according to the first embodiment, illustrating a state where a leading edge of the sheet conveyed along the reconveying path by the reconveying rollers reaches a pre-registration sensor positioned upstream relative to a registration roller in a conveying direction of the sheet.

Then, as illustrated in FIG. 9B, when the leading edge of the sheet S conveyed by the reconveying rollers 36, 36 along the reconveying path L2 reaches the pre-registration sensor S1 and the pre-registration sensor S1 is rendered ON, the rotating direction of the motor 4 is switched from the reverse direction to the normal direction under the control of the controller 41. When the rotating direction of the motor 4 is switched to the normal direction, the rotating direction of the input gear 21 is switched from the reverse direction to the normal direction (clockwise direction in FIGS. 5A and 5B) as illustrated in FIGS. 5A and 5B. Further, when the rotating direction of the motor 4 is switched to the normal direction, the registration roller 34 and other rollers constituting the conveying unit 6 starts rotating.

When the input gear 21 is rotated in the normal direction, the revolving member 27 revolves in the same direction as the rotating direction of the input gear 21 to be moved from the first revolving position to the second revolving position. When the revolving member 27 is moved to the second revolving position, the second swinging gear 26 moves toward the second gear 23 to mesh with the second toothed part 23*a*. On the other hand, the first swinging gear 25 separates from the output gear 22.

As a result, the rotational drive force from the input gear 21 is transmitted to the intermediate gear 29 through the second swinging gear 26.

Further, when the revolving member 27 is located at the second revolving position, the engaging part 27*a* is located at the lock position. However, at the rotation position of the intermediate gear 29 illustrated in FIG. 5A where the second swinging gear 26 meshes with the second toothed part 23*a*, the engagement part 23*d* is positioned downstream relative to a position engageable with the engaging part 27*a* in the rotation direction of the intermediate gear 29. Thus, the engagement part 23*d* does not engage with the engaging part 27*a*, and therefore, the intermediate gear 29 is rotated in the same direction as the rotating direction of the input gear 21 by the rotational drive force transmitted thereto through the second swinging gear 26.

Figure 6A:
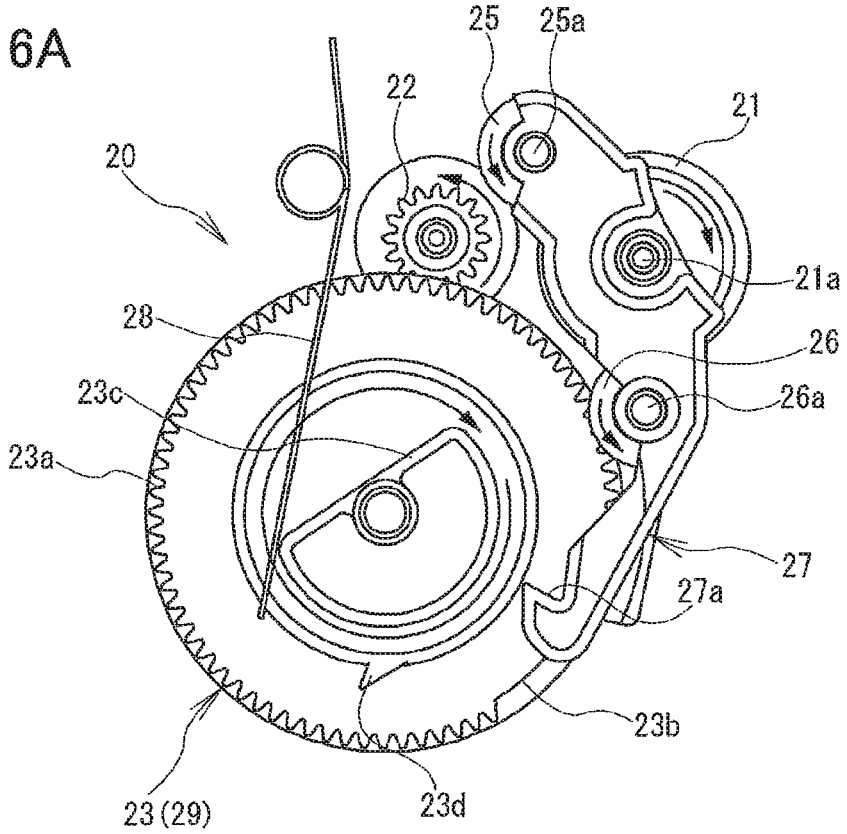
FIGS. 6A and 6B are side views of the second transmission mechanism according to the first embodiment, illustrating a state where, in accordance with rotation of an intermediate gear driven by a drive force transmitted through the second swinging gear, the output gear meshes with a first toothed part of the first gear to be rotationally driven, in which FIG. 6A particularly illustrates the relationship between the output gear and the first swinging gear and the relationship between the second gear which is a part of the intermediate gear and the second swinging gear.
Figure 6B:
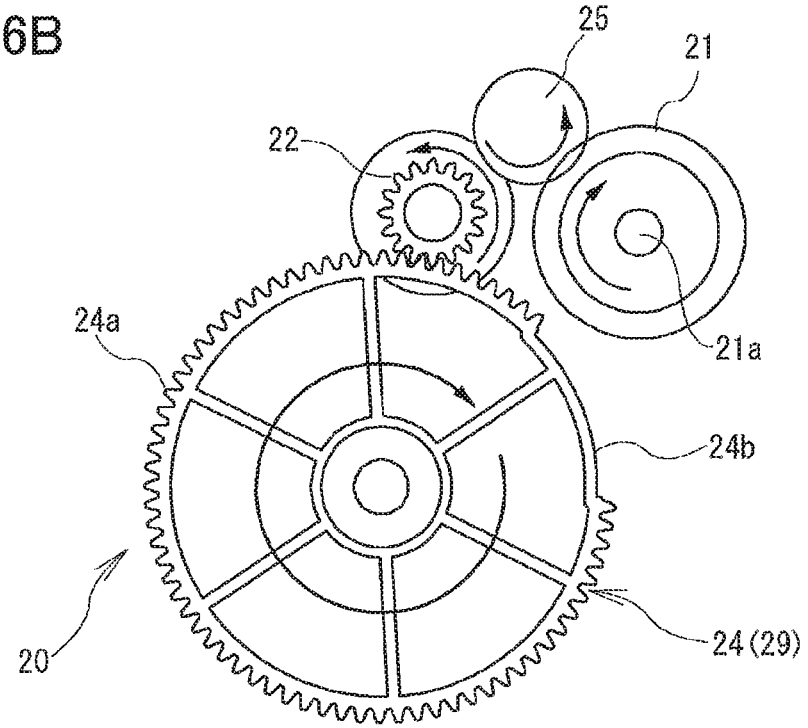

When the intermediate gear 29 is rotated, the first gear 24 is switched from a rotation position where the first toothless part 24*b* confronts the output gear 22 (FIG. 5B) to a rotation position where the first toothed part 24*a* confronts the output gear 22 (FIG. 6B).

That is, at a time point when the intermediate gear 29 starts rotating with the rotational drive force transmitted thereto through the second swinging gear 26, the first toothless part 24*b* is located at a position confronting the output gear 22. Therefore, at this time, the output gear 22 is not rotationally driven. Then, as illustrated in FIGS. 6A and 6B, when the intermediate gear 29 is rotated to cause the first toothed part 24*a* to be located at a position confronting the output gear 22, the output gear 22 meshes with the first toothed part 24*a*, and the output gear 22 is rotationally driven in the reverse direction that is a direction opposite to the rotating direction of the input gear 21.

When the output gear 22 is rotated in the reverse direction, the reconveying rollers 36, 36 are driven to rotate in the reconveying mode for conveying the sheet S in the reconveying direction from the branch portion L3 toward the rejoining portion L4 along the reconveying path L2.

In this way, when the rotating direction of the motor 4 is switched from the reverse direction to the normal direction, the second transmission mechanism 20 operates in the second transmission mode that reverses the direction of the rotational drive force supplied from the motor 4 and outputs the reversed drive force toward the reconveying rollers 36, 36.

The intermediate gear 29 rotationally driven through the second swinging gear 26 is rotated in the clockwise direction from a rotation position where the second swinging gear 26 meshes with a furthest upstream portion of the second toothed part 23*a* adjacent to the second toothless part 23*b* and positioned on an upstream side of the second toothless part 23*b* in the rotating direction to a rotation position where the second swinging gear 26 meshes with a furthest downstream portion of the second toothed part 23*a* adjacent to the second toothless part 23*b* and positioned on a downstream side of the second toothless part 23*b* in the rotating direction, and then, to the rotation position where the second toothless part 23*b* confronts the second swinging gear 26. When the second toothless part 23*b* reaches a position confronting the second swinging gear 26, the drive force is not transmitted to the intermediate gear 29 through the second swinging gear 26. As a result, the rotation of the intermediate gear 29 by this drive force is halted.

While the intermediate gear 29 is rotated from a rotation position immediately after the rotation position where the second swinging gear 26 meshes with the furthest upstream portion of the second toothed part 23*a* to a rotation position immediately before the rotation position where the second swinging gear 26 meshes with the furthest downstream portion of the second toothed part 23*a*, the output gear 22 meshes with the first toothed part 24*a* of the first gear 24. Hence, the output gear 22 is rotated in the reverse direction that is a direction opposite to the rotating direction of the input gear 21.

That is, when the rotating direction of the motor 4 is switched from the reverse direction to the normal direction, the reconveying rollers 36, 36 are driven to rotate in the reconveying mode by the predetermined number of rotations while the intermediate gear 29 is rotated by almost one rotation from the rotation position where the second swinging gear 26 meshes with the furthest upstream portion of the second toothed part 23*a* to the rotation position where the second swinging gear 26 meshes with the furthest downstream portion of the second toothed part 23*a*.

While the intermediate gear 29 is rotated by almost one rotation through the second swinging gear 26 after the rotating direction of the motor 4 is switched to the normal direction, the sheet S continues to be conveyed toward the image forming unit 5 by the reconveying rollers 36, 36. At a time point when the rotation of the intermediate gear 29 is halted, the leading edge of the sheet S is positioned downstream relative to the registration roller 34 in the conveying direction. Thereafter, the sheet S is conveyed by the registration roller 34 and other rollers constituting the conveying unit 6 along the conveying path L1.

Figure 7A:
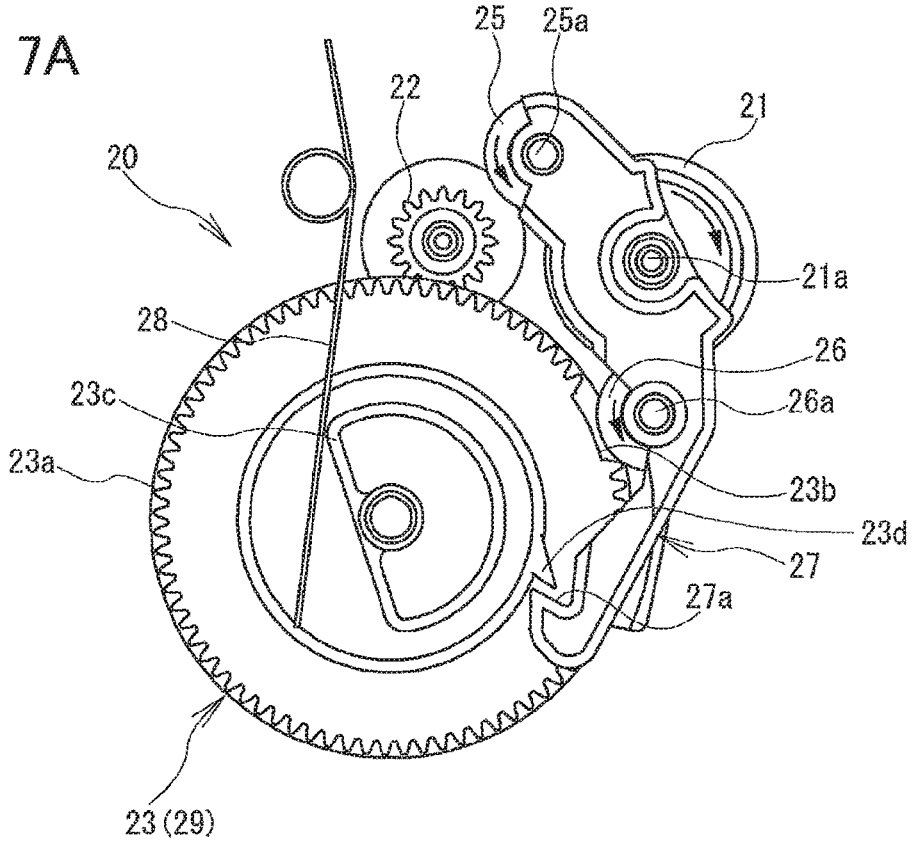
FIGS. 7A and 7B are side views of the second transmission mechanism according to the first embodiment, illustrating a state where the intermediate gear has been rotated by almost 360 degrees after the rotating direction of the motor is switched from the reverse direction to the normal direction, in which FIG. 7A particularly illustrates the relationship between the output gear and the first swinging gear and the relationship between the second gear and the second swinging gear.
Figure 7B:
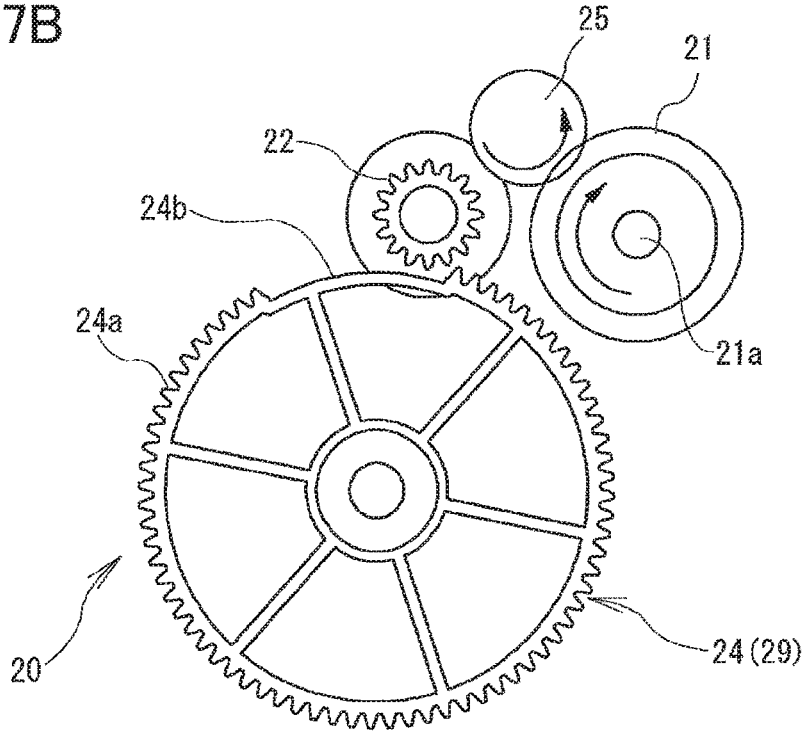

As illustrated in FIGS. 7A and 7B, when the intermediate gear 29 rotationally driven through the second swinging gear 26 is rotated from the rotation position (an example of a first rotation position) where the furthest downstream portion of the second toothed part 23*a* confronts the second swinging gear 26 to the rotation position (an example of a second rotation position) where the second toothless part 23*b* confronts the second swinging gear 26, the resilient member 28 abuts against the boundary in the cam part 23*c* of the second gear 23 to rotate the intermediate gear 29 by the urging force of the resilient member 28.

The intermediate gear 29 rotated by the urging force of the resilient member 28 stops rotating when reaching the rotation position where the engagement part 23*d* is engaged with the engaging part 27*a*, and is maintained at the rotation position where the second toothless part 23*b* confronts the second swinging gear 26.

In this case, when the intermediate gear 29 is rotated from the rotation position where the second toothed part 23*a* confronts the second swinging gear 26 to the rotation position where the second toothless part 23*b* confronts the second swinging gear 26, the first toothless part 24*b* of the first gear 24 has already reached the position confronting the output gear 22.

That is, while the intermediate gear 29 is rotated through the second swinging gear 26, the first toothless part 24*b* of the first gear 24 reaches the position confronting the output gear 22, and then, the second toothless part 23*b* of the second gear 23 reaches the position confronting the second swinging gear 26.

Thus, in a state where the intermediate gear 29 is at the rotation position where the first toothless part 24*b* confronts the output gear 22, the resilient member 28 urges the intermediate gear 29 so that the intermediate gear 29 is rotated from the rotation position where the second toothed part 23*a* confronts the second swinging gear 26 to the rotation position where the second toothless part 23*b* confronts the second swinging gear 26.

Thus, while the intermediate gear 29 is rotated by the urging force of the resilient member 28 from the rotation position where the second toothed part 23*a* confronts the second swinging gear 26 to the rotation position where the second toothless part 23*b* confronts the second swinging gear 26, the first gear 24 does not mesh with the output gear 22. Thus, no load is applied from the output gear 22 to the intermediate gear 29. Accordingly, even if the urging force of the resilient member 28 is small, the intermediate gear 29 can reliably be rotated to and maintained at the rotation position where the second toothless part 23*b* confronts the second swinging gear 26.

<Driven Roller Provided at Chute Member>

Figure 10A:
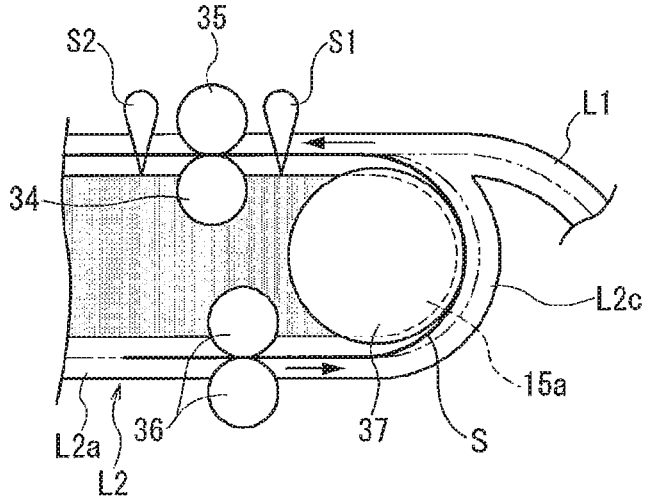
FIG. 10A is a schematic cross-sectional view of a driven roller provided at a guide surface of a chute member according to the first embodiment.

As illustrated in FIG. 10A, in the image forming apparatus 1, a driven roller 37 is provided at the chute member 15. More specifically, the driven roller 37 is provided at a portion of the chute member 15 providing the guide surface 15*a* that forms the inner peripheral surface of the second curved portion L2*c* in the reconveying path L2. In other words, the driven roller 37 is disposed at the inner peripheral surface of the second curved portion L2*c*.

The driven roller 37 is a roller whose outer peripheral surface protrudes into the second curved portion L2*c* from the guide surface 15*a*. In other words, the outer peripheral surface of the driven roller 37 is positioned further inward than the guide surface 15*a*. The driven roller 37 is rotated upon contact with the sheet S conveyed along the second curved portion L2*c*. The driven roller 37 is disposed at the reconveying path L2 between the reconveying rollers 36, 36 and the registration roller 34, that is, at the second curved portion L2*c*.

The driven roller 37 has a diameter slightly larger than a diameter of the guide surface 15*a* formed into an arcuate shape. The driven roller 37 protrudes inside the second curved portion L2*c* to a position further inward than the guide surface 15*a* over substantially the entire region of the guide surface 15*a* in the conveying direction of the sheet S.

Thus, the sheet S conveyed along the second curved portion L2*c* can be made to contact the outer peripheral surface of the driven roller 37 across substantially the entire region of the second curved portion L2*c* in the conveying direction.

Figure 11:
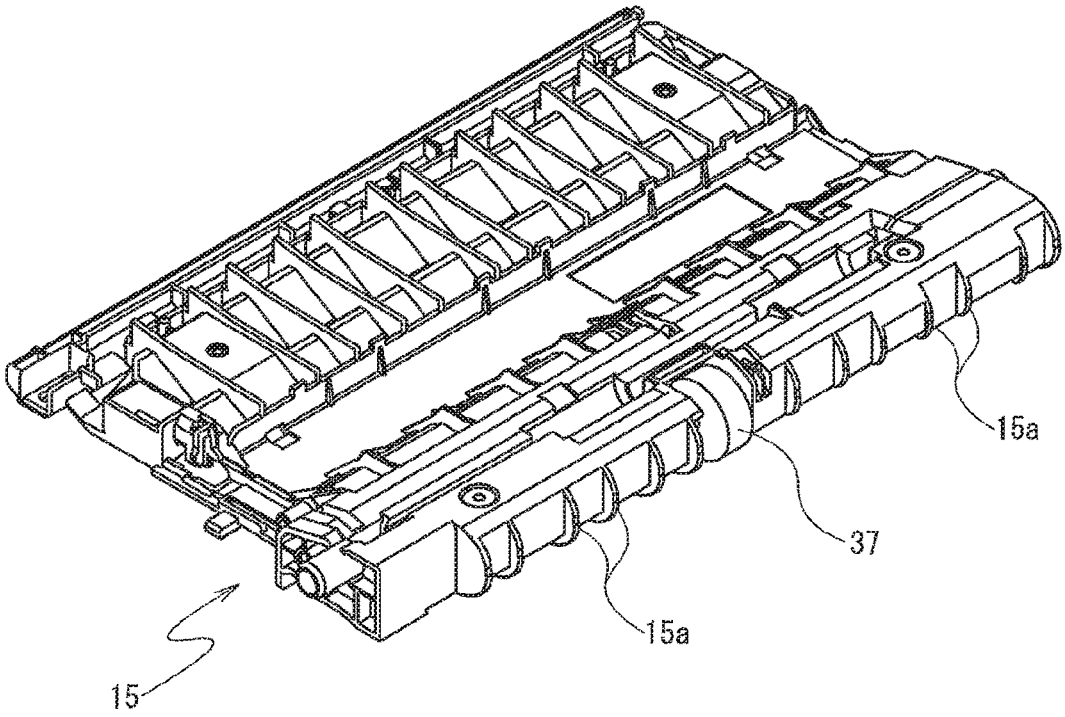
FIG. 11 is a perspective view of the chute member according to the first embodiment, particularly illustrating the drive roller.

As illustrated in FIG. 11, the driven roller 37 is disposed at substantially a center portion of the second curved portion L2*c* in a direction perpendicular to the conveying direction.

There may be a case where the sheet S conveyed along the second curved portion L2*c* is conveyed by the rotational drive force of the registration roller 34 while being nipped between the reconveying rollers 36, 36 and between the registration roller 34 and the opposing roller 35. In such a case, in the absence of the driven roller 37 at the guide surface 15*a*, the sheet S is conveyed while contacting the guide surface 15*a* over substantially the entire region of the chute member 15 in a widthwise direction of the sheet S.

When the sheet S is conveyed while contacting the guide surface 15*a* over such a broad area, a friction force is generated between the sheet S and the guide surface 15*a*. Thus, drive torque of the registration roller 34 required for conveying the sheet S becomes greater.

However, the driven roller 37 is provided at a portion of the chute member 15 providing the guide surface 15*a*. This configuration can reduce a contact area between the sheet S and the guide surface 15*a*, thereby reducing the friction force generated between the sheet S and the guide surface 15*a*. Thus, the drive torque of the registration roller 34 required for conveying the sheet S can be made small.

Incidentally, a friction force generated between the sheet S and the driven roller 37 is negligible at a position where the sheet S contacts the driven roller 37 since the driven roller 37 is rotated while following the conveyance of the sheet S.

<Modifications of Driven Roller>

Figure 10B:
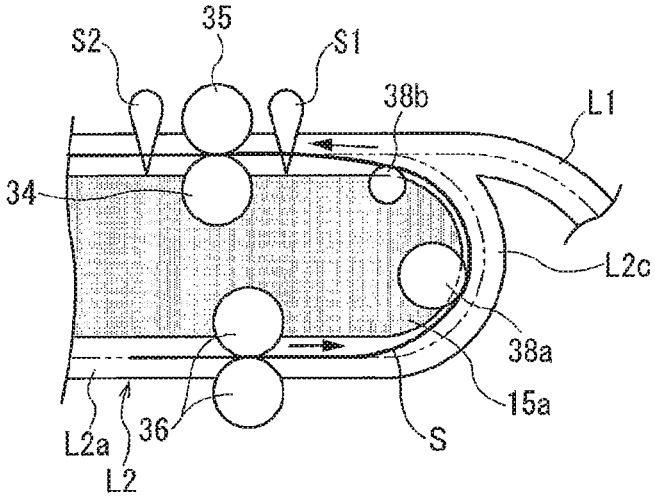
FIG. 10B is a schematic cross-sectional view of a driven roller provided at a guide surface of a chute member according to a first modification to the first embodiment.

FIG. 10B illustrates a plurality of driven rollers 38*a*, 38*b* according to a first modification to the first embodiment.

In place of the driven roller 37, the plurality of drive rollers 38*a*, 38*b* rotating upon contact with the sheet S conveyed along the second curved portion L2*c* may be provided at a portion of the chute member 15 providing the guide surface 15*a*. The plurality of driven rollers 38*a*, 38*b* is disposed at the reconveying path L2 between the reconveying rollers 36, 36 and the registration roller 34. In other words, the plurality of driven rollers 38*a*, 38*b* is disposed at the inner peripheral surface of the second curved portion L2*c*.

The plurality of driven rollers 38*a*, 38*b* is each a roller having a diameter smaller than the diameter of the guide surface 15*a*. The plurality of driven rollers 38*a*, 38*b* each has an outer peripheral surface protruding into the second curved portion L2*c* from the guide surface 15*a*. The driven roller 38*a* has a diameter greater than that of the driven roller 38*b*.

The driven roller 38*a* is disposed upstream relative to the driven roller 38*b* in the conveying direction. The driven roller 38*a* is disposed slightly upstream relative to a center portion of the second curved portion L2*c* in the conveying direction. The driven roller 38*b* is disposed at a downstream end portion of the second curved portion L2*c* in the conveying direction.

The plurality of driven rollers 38*a*, 38*b* is each rotated when the sheet S conveyed along the second curved portion L2*c* contacts a part of the outer peripheral surface thereof protruding inward from the guide surface 15*a*.

In this way, the plurality of driven rollers 38*a*, 38*b* having different diameters can be provided at a portion of the chute member 15 providing the guide surface 15*a*.

Figure 10C:
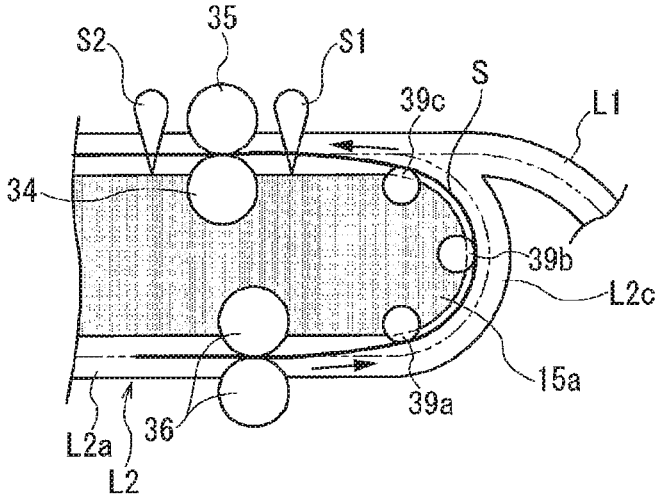
FIG. 10C is a schematic cross-sectional view of a driven roller provided at a guide surface of a chute member according to a second modification to the first embodiment.

FIG. 10C illustrates a plurality of driven rollers 39*a*, 39*b*, 39*c* according to a second modification to the first embodiment.

In place of the driven roller 37, the plurality of driven rollers 39*a*, 39*b*, 39*c* rotating upon contact with the sheet S conveyed along the second curved portion L2*c* may be provided at a portion of the chute member 15 providing the guide surface 15*a*. The plurality of driven rollers 39*a*, 39*b*, 39*c* is disposed at the reconveying path L2 between the reconveying rollers 36, 36 and the registration roller 34. In other words, the plurality of driven rollers 39*a*, 39*b*, 39*c* is disposed at the inner peripheral surface of the second curved portion L2*c*.

The plurality of driven rollers 39*a*, 39*b*, 39*c* is each a roller having a diameter smaller than the diameter of the guide surface 15*a*. The plurality of driven rollers 39*a*, 39*b*, 39*c* each has an outer peripheral surface protruding into the second curved portion L2*c* from the guide surface 15*a*. The plurality of driven rollers 39*a*, 39*b*, 39*c* have the same diameter.

The driven roller 39*a* is disposed upstream relative to the driven roller 39*b* in the conveying direction. The driven roller 39*b* is disposed upstream relative to the driven roller 39*c* in the conveying direction. The driven roller 39*a* is disposed at an upstream end portion of the second curved portion L2*c* in the conveying direction. The driven roller 39*b* is disposed at a center portion of the second curved portion L2*c* in the conveying direction. The driven roller 39*c* is disposed at a downstream end portion of the second curved portion L2*c* in the conveying direction.

The plurality of driven rollers 39*a*, 39*b*, 39*c* is each rotated when the sheet S conveyed along the second curved portion L2*c* contacts a part of the outer peripheral surface thereof protruding inward from the guide surface 15*a*.

In this way, the plurality of driven rollers 39*a*, 39*b*, 39*c* having the same diameter can be provided at a portion of the chute member 15 providing the guide surface 15*a*.

<Operational Advantages of First Embodiment>

The image forming apparatus 1 is configured as described above.

That is, the image forming apparatus 1 includes the sheet cassette 30, the image forming unit 5, the discharge tray 82, the conveying unit 6, the reconveying unit 7, the switchback rollers 81, 81, the motor 4, the first transmission mechanism 11, and the second transmission mechanism 20.

The reconveying unit 7 includes the reconveying rollers 36, 36.

The second transmission mechanism 20 transmits a drive force to the reconveying rollers 36, 36 to rotate the reconveying rollers 36, 36 in the reconveying mode for conveying the sheet S in the reconveying direction from the branch portion L3 toward the rejoining portion L4 while the motor 4 supplies a drive force in the reverse direction to the second transmission mechanism 20. Further, the second transmission mechanism 20 transmits a drive force to the reconveying rollers 36, 36 to rotate the reconveying rollers 36, 36 by the predetermined number of rotations in the reconveying mode for conveying the sheet S in the reconveying direction from the branch portion L3 toward the rejoining portion L4 after the rotating direction of the drive force supplied from the motor 4 is switched from the reverse direction to the normal direction, and then, interrupts transmission of the drive force to the reconveying rollers 36, 36.

The second transmission mechanism 20 includes the input gear 21, the output gear 22, the intermediate gear 29 including the first gear 24 and the second gear 23, the first swinging gear 25, the second swinging gear 26, the revolving member 27, the resilient member 28, and the locking mechanism.

The input gear 21 is rotated upon receipt of a drive force supplied from the motor 4. The output gear 22 outputs the drive force to the reconveying rollers 36, 36. The first gear 24 has the first toothed part 24*a* and the first toothless part 24*b*. The first toothed part 24*a* has gear teeth and is capable of meshing with the output gear 22. The first toothless part 24*b* has no gear teeth. The second gear 23 has the second toothed part 23*a* having gear teeth and the second toothless part 23*b* having no gear teeth. The first gear 24 and the second gear 23 can rotate coaxially and integrally with each other. The first swinging gear 25 meshes with the input gear 21. The second swinging gear 26 meshes with the input gear 21. The revolving member 27 supports the first swinging gear 25 and the second swinging gear 26 such that the first planetary gear 25 is rotatable about a rotational axis thereof, the second planetary gear 26 is rotatable about a rotational axis thereof, and the first swinging gear 25 and the second swinging gear 26 are swingably movable about a rotation axis of the input gear 21 while meshing with the input gear 21.

The revolving member 27 revolves, with the drive force transmitted to the input gear 21 acting as a revolving member, between the first revolving position where the first swinging gear 25 meshes with the output gear 22 and the second swinging gear 26 is separated from the second gear 23, and the second revolving position where the first swinging gear 25 is separated from the output gear 22 and the second swinging gear 26 is capable of meshing with the second gear 23. While the motor 4 supplies a drive force in the reverse direction to the second transmission mechanism 20, the revolving member 27 moves to the first revolving position. While the motor 4 supplies a drive force in the normal direction to the second transmission mechanism 20, the revolving member 27 moves to the second revolving position.

The resilient member 28 urges the intermediate gear 29 in the rotating direction of the intermediate gear 29 from the rotation position where the second toothed part 23*a* is located at a position confronting the second swinging gear 26 to the rotation position where the second toothless part 23*b* is located at a position confronting the second swinging gear 26 while the first toothless part 24*b* is located at a position confronting the output gear 22.

The locking mechanism locks the rotation of the intermediate gear 29 at the rotation position where the second toothless part 23*b* is located at a position confronting the second swinging gear 26.

The first toothless part 24*b* and the second toothless part 23*b* are provided at such a position that, when the intermediate gear 29 is rotated upon receipt of the drive force transmitted from the input gear 21 through the second swinging gear 26 while the second swinging gear 26 meshes with the second toothed part 23*a* and the output gear 22 meshes with the first toothed part 24*a*, the first toothless part 24*b* reaches a position confronting the output gear 22 and then the second toothless part 23*b* reaches a position confronting the second swinging gear 26.

With this configuration, while the reconveying rollers 36, 36 do not convey the sheet S, rotation of the reconveying rollers 36, 36 is stopped. Thus, noise caused by the reconveying rollers 36, 36 can be reduced, and frictional wearing of the reconveying rollers 36, 36 and their neighboring components can be restrained.

Further, when the intermediate gear 29 rotated by the drive force transmitted to the second toothed part 23*a* through the second swinging gear 26 is rotated to a position where meshing between the second toothed part 23*a* and the second swinging gear 26 is released, meshing between the output gear 22 and the first toothed part 24*a* has already been released.

Therefore, no load is applied from the output gear 22 to the intermediate gear 29. Thus, the intermediate gear 29 can reliably be rotated to a position where meshing between the second toothed part 23*a* and the second swinging gear 26 is released even with a small urging force. Accordingly, noise generation due to rotation of the intermediate gear 29 in a state where the second toothed part 23*a* contacts the second planetary gear 26 can reliably be prevented.

The locking mechanism includes the engagement part 23*d* and the engaging part 27*a*. The engagement part 23*d* is provided at the second gear 23 of the intermediate gear 29. The engaging part 27*a* is provided at the revolving member 27 and engageable with the engagement part 23*d*. When the revolving member 27 is located at the second revolving position, the engaging part 27*a* is located at the lock position where the engaging part 27*a* is in engagement with the engagement part 23*d*. When the revolving member 27 is located at the first revolving position, the engaging part 27*a* is located at the lock release position where the engaging part 27*a* is out of engagement with the engagement part 23*d*. When located at the lock position, the engaging part 27*a* is in engagement with the engagement part 23*d* to lock the rotation of the intermediate gear 29 at the rotation position where the second toothless part 23*b* is located at a position confronting the second swinging gear 26.

When the resilient member 28 urges the intermediate gear 29 to locate the engaging part 27*a* at the lock position, the locking mechanism maintains the intermediate gear 29 at the rotation position where the second toothless part 23*b* is located at a position confronting the second swinging gear 26 by the urging force of the resilient member 28. When the resilient member 28 urges the intermediate gear 29 to locate the engaging part 27*a* at the lock release position, the locking mechanism allows the intermediate gear 29 to be rotated by the urging force of the resilient member 28 to the rotation position where the second swinging gear 26 meshes with the second toothed part 23*a* of the second gear 23 in response to the movement of the revolving member 27 to the second revolving position.

Thus, even if the urging force of the resilient member 28 is set to be small, the intermediate gear 29 can reliably be maintained, by the urging force of the resilient member 28, at the rotation position where the second toothless part 23*b* is located at a position confronting the second swinging gear 26 when the engaging part 27*a* is located at the lock position. Further, the intermediate gear 29 can reliably be rotated, by the urging force of the resilient member 28, to the rotation position where the second swinging gear 26 meshes with the second toothed part 23*a* of the second gear 23 when the engaging part 27*a* is located at the lock release position.

Further, when the engaging part 27*a* is located at the lock release position, and when the intermediate gear 29 is rotated by the urging force of the resilient member 28 from the rotation position where the second toothless part 23*b* is located at a position confronting the second swinging gear 26 to the rotation position where the second swinging gear 26 meshes with the second toothed part 23*a* of the second gear 23 in response to the movement of the revolving member 27 to the second revolving position, the first toothless part 24*b* is located at a position confronting the output gear 22.

With this configuration, the first toothless part 24*b* is located at a position confronting the output gear 22 when the intermediate gear 29 is rotated by the urging force of the resilient member 28 from the rotation position where the second toothless part 23*b* is located at a position confronting the second swinging gear 26 to the rotation position where the second swinging gear 26 meshes with the second toothed part 23*a* of the second gear 23 in response to the movement of the revolving member 27 to the second revolving position. Thus, no load is applied from the output gear 22 to the intermediate gear 29. Accordingly, even if the urging force of the resilient member 28 is set small, the intermediate gear 29 can reliably be rotated by the urging force of the resilient member 28 to the rotation position where the second swinging gear 26 meshes with the second toothed part 23*a* of the second gear 23.

The reconveying path L2 includes the reconveying portion L2*a* at which the reconveying rollers 36, 36 are disposed, and the second curved portion L2*c* extending between the reconveying portion L2*a* and the rejoining portion L4 and formed into a curved shape. The driven roller 37 is provided at the inner peripheral surface of the second curved portion L2*c*. The driven roller 37 is rotated upon contacting the sheet S conveyed along the second curved portion L2*c*.

The sheet S conveyed along the second curved portion L2*c* may be conveyed by the registration roller 34 while being nipped between the reconveying rollers 36, 36 and between the registration roller 34 and the opposing roller 35. In such a case, the sheet S contacts the inner peripheral surface of the second curved portion L2*c* to cause a friction force between the sheet S and the inner peripheral surface. However, by providing the driven roller 37 at the second curved portion L2*c*, the friction force generated between the inner peripheral surface of the second curved portion L2*c* and the sheet S can be reduced to thereby reduce a drive torque required for conveying the sheet S passing through the second curved portion L2*c*.

The driven roller 37 is a roller whose outer peripheral surface can contact the sheet S over substantially the entire region of the second curved portion L2*c* in the conveying direction.

Thus, a contact area between the sheet S passing through the second curved portion L2*c* and the inner peripheral surface of the second curved portion L2*c* can be reduced, thereby reducing the friction force between the inner peripheral surface of the second curved portion L2*c* and the sheet S.

The driven roller 37 is disposed at a substantially center portion of the second curved portion L2*c* in a direction perpendicular to the conveying direction.

Thus, since the sheet S passes through a center portion of the second curved portion L2*c* in the direction perpendicular to the conveying direction, sheets S of various sizes can be properly conveyed. This configuration also prevents the conveyed sheet S from being oblique, avoiding conveying failure of the sheet S.

Further, the second transmission mechanism 20 includes the input gear 21, the output gear 22, the intermediate gear 29 having the first gear 24 and the second gear 23, the first swinging gear 25, the second swinging gear 26, the revolving member 27, the resilient member 28, and the locking mechanism.

The first toothless part 24*b* of the first gear 24 and the second toothless part 23*b* of the second gear 23 are provided at such a position that, when the intermediate gear 29 is rotated by the drive force transmitted from the input gear 21 through the second swinging gear 26 while the second swinging gear 26 meshes with the second toothed part 23*a* of the second gear 23 and the output gear 22 meshes with the first toothed part 24*a* of the first gear 24, the first toothless part 24*b* reaches a position confronting the output gear 22, and then the second toothless part 23*b* reaches a position confronting the second swinging gear 26.

Thus, even if the urging force of the resilient member 28 is set to be small, the intermediate gear 29 can reliably maintained, by the urging force of the resilient member 28, at the rotation position where the second toothless part 23*b* is located at a position confronting the second swinging gear 26 when the engaging part 27*a* is located at the lock position. Further, the intermediate gear 29 can reliably be rotated, by the urging force of the resilient member 28, to the rotation position where the second swinging gear 26 meshes with the second toothed part 23*a* of the second gear 23 when the engaging part 27*a* is located at the lock release position.

<Second Embodiment>

Next, an image forming apparatus 101 according to a second embodiment will be described with reference to FIGS. 12 through 19B, wherein like parts and components are designated by the same reference numerals as those of the above-described first embodiment to avoid duplicating description. The image forming apparatus 101 according to the second embodiment differs from the image forming apparatus 1 according to the first embodiment in that the image forming apparatus 101 includes a second transmission mechanism 120 in place of the second transmission mechanism 20. Hence, in the following description, only parts differing from those of the above-described first embodiment will be described in detail.

<Configuration of Second Transmission Mechanism>

A configuration of the second transmission mechanism 120 as an example of a transmission mechanism will be described.

Figure 12:
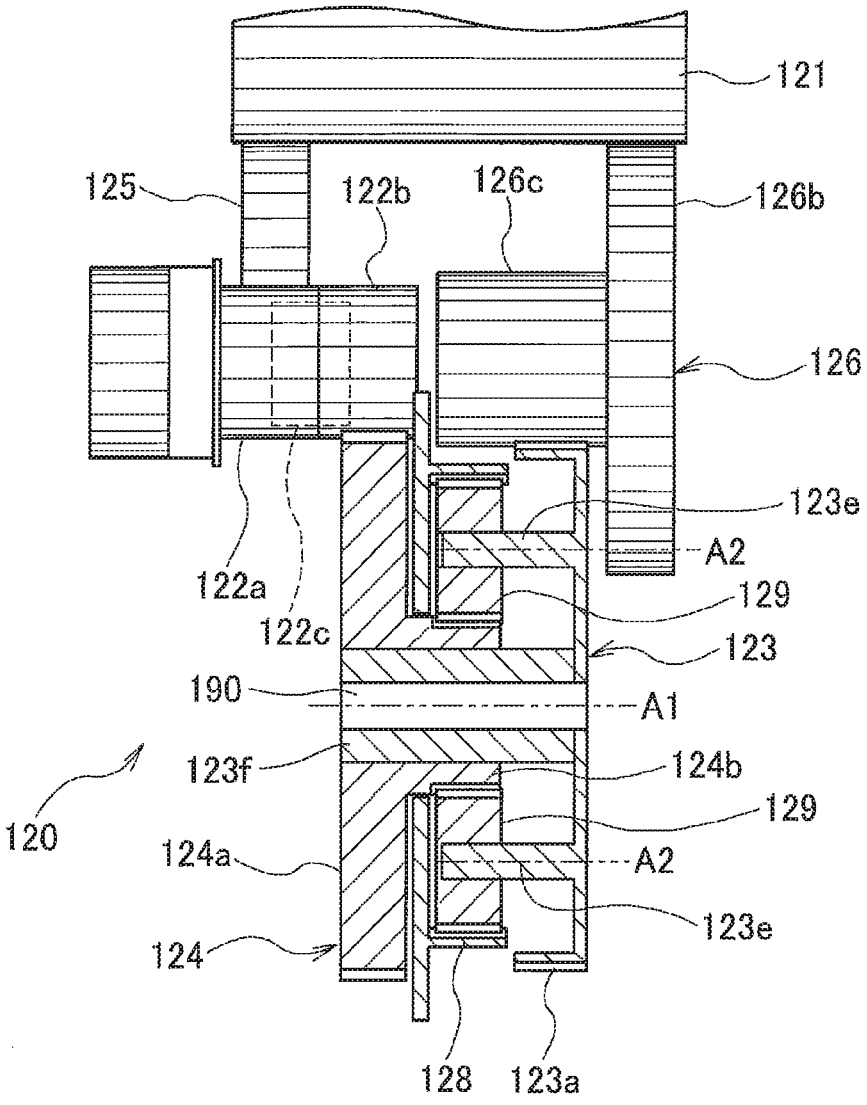
FIG. 12 is a partial cross-sectional explanatory view of a second transmission mechanism according to a second embodiment.
Figure 13:
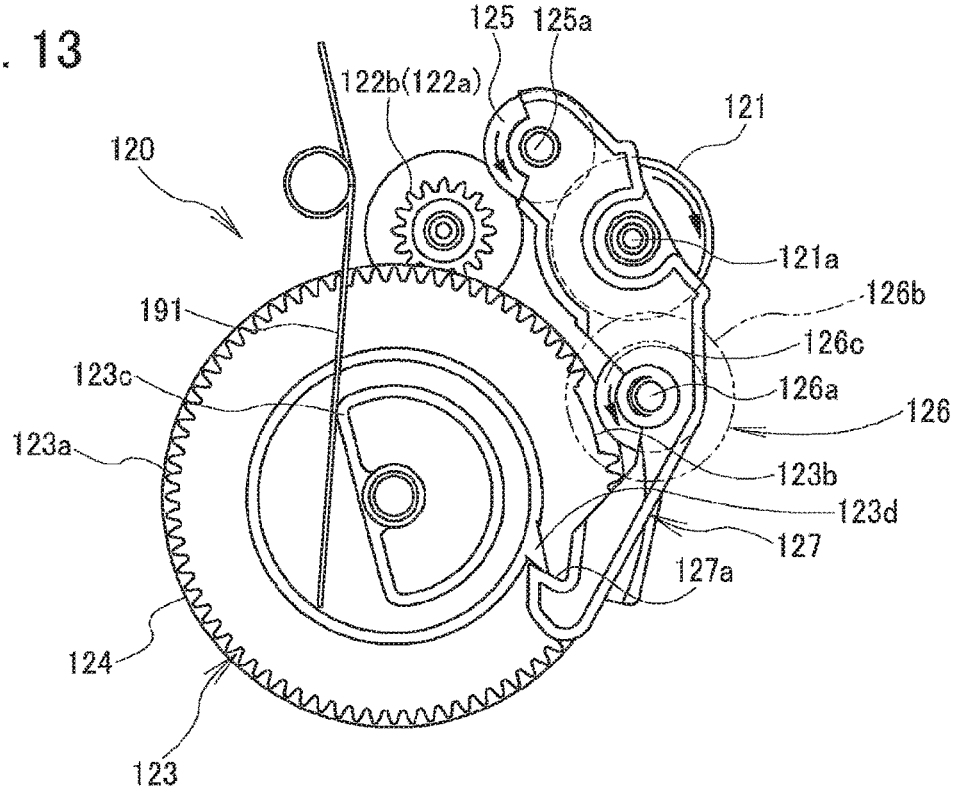
FIG. 13 is a side view of the second transmission mechanism according to the second embodiment when the motor is rotated in the normal direction, particularly illustrating a relationship between a first drive gear and a first swinging gear and a relationship between a second intermediate gear and a second swinging gear.

As illustrated in FIGS. 12 and 13, the second transmission mechanism 120 includes: an input gear 121; a first drive gear

122*a*; a second drive gear 122*b*; a first swinging gear 125; a second swinging gear 126; a first two-stage gear 124 including a first intermediate gear 124*a* and a sun gear 124*b*; an internal gear 128; a plurality of planetary gears 129; a second intermediate gear 123; a one-way clutch 122*c*; a revolving member 127; a resilient member 191 (an example of an urging member); and a locking mechanism.

The input gear 121 is configured to rotate upon receipt of the drive force supplied from the motor 4. The first drive gear 122*a* is configured to output the drive force to the reconveying rollers 36, 36. The second drive gear 122*b* is configured to rotate coaxially with the first drive gear 122*a*. The first swinging gear 125 meshes with the input gear 121. The second swinging gear 126 meshes with the input gear 121. The first intermediate gear 124*a* meshes with the second drive gear 122*b*. The internal gear 128 has inner gear teeth formed on an inner peripheral surface thereof. The plurality of planetary gears 129 is disposed between the sun gear 124*b* and the internal gear 128. The second intermediate gear 123 is configured to rotate about a rotational axis A1 (an example of a first rotational axis) of the first intermediate gear 124*a*. The one-way clutch 122*c* is disposed between the first drive gear 122*a* and the second drive gear 122*b*. The revolving member 127 supports the first swinging gear 125 and the second swinging gear 126, and is configured to revolve about an axis of a rotation shaft 121*a* of the input gear 121. The resilient member 191 is configured to urge the second intermediate gear 123 in a rotating direction of the second intermediate gear 123. The locking mechanism configured to lock the rotation of the second intermediate gear 123 at a predetermined rotation position.

More specifically, the input gear 121 receives the drive force supplied from the motor 4 to thereby be rotated in a rotating direction according to the rotating direction of the motor 4. The revolving member 127 is supported to the rotation shaft 121*a* of the input gear 121 so as to revolve about the axis of the rotation shaft 121*a*.

Incidentally, the input gear 121 may not have the rotation shaft 121*a*, the revolving member 127 may have a pivot shaft, the input gear 121 may be supported by the pivot shaft as long as the revolving member 127 can revolve about the rotation axis of the input gear 121.

In the first two-stage gear 124, the first intermediate gear 124*a* has a diameter greater than that of the sun gear 124*b*. The sun gear 124*b* can rotate integrally with the first intermediate gear 124*a* about the rotational axis A1. In other words, the first intermediate gear 124*a* and the sun gear 124*b* can rotate integrally and coaxially with each other.

The internal gear 128 is disposed coaxially with the first two-stage gear 124. In other words, the internal gear 128 has a center axis coincident with the rotational axis A1 of the first intermediate gear 124*a*. The internal gear 128 is fixed to a frame of the main casing 2. That is, the internal gear 128 is stationary and incapable of rotating about the rotational axis A1.

The plurality of planetary gears 129 disposed between the sun gear 124*b* and the internal gear 128 each meshes with both the sun gear 124*b* and the internal gear 128.

The second intermediate gear 123 is configured to rotate relative to the first two-stage gear 124 and the internal gear 128 about the rotational axis A1.

The second intermediate gear 123 has a toothed part 123*a* having gear teeth and a toothless part 123*b* having no gear teeth. Further, the second intermediate gear 123 has a cam part 123*c* and an engagement part 123*d*. The cam part 123*c* is rib-shaped having an arcuate portion and a linear portion. The arcuate portion is formed into an arcuate shape centered on the rotational axis A1. The linear portion connects both ends of the arcuate portion.

The second intermediate gear 123 further has a plurality of support parts 123*e* supporting the plurality of planetary gears 129, respectively. The plurality of support parts 123*e* respectively supports the plurality of planetary gears 129 such that the plurality of planetary gears 129 is rotatable about their rotational axes A2 and orbitally movable about the rotational axis A1.

The second intermediate gear 123 further has a bearing part 123*f*. A shaft 190 fixed to the frame of the main casing 2 extends through the bearing part 123*f* and has an axis coincident with the rotational axis A1. The shaft 190 is supported to the bearing part 123*f* such that the bearing part 123*f* is rotatable about the shaft 190. The second intermediate gear 123 is thus configured to rotate about the shaft 190. The first two-stage gear 124 is configured to rotate about the bearing portion 123*f*.

Incidentally, the bearing part 123*f* may be provided separately from the second intermediate gear 123 and fixed to the frame of the main casing 2 while the shaft 190 may be formed integrally with the second intermediate gear 123, and the second intermediate gear 123 may be rotatable about the bearing part 123*f*.

The one-way clutch 122*c* is configured to transmit rotation of the second drive gear 122*b* rotationally driven by the first intermediate gear 124*a* to the first drive gear 122*a*, and also configured not to transmit rotation of the first drive gear 122*a* rotationally driven by the first swinging gear 125 to the second drive gear 122*b*.

The second swinging gear 126 is a second two-stage gear. The second swinging gear 126 includes a large-diameter gear 126*b* and a small-diameter gear 126*c*. The large-diameter gear 126*b* meshes with the input gear 121 and has a rotational shaft 126*a*. The small-diameter gear 126*c* can rotate integrally with the large-diameter gear 126*b* about an axis of the rotational shaft 126*a*. The small-diameter gear 126*c* has gear teeth whose number is smaller than that of gear teeth of the large-diameter gear 126*b*. The small-diameter gear 126*c* is capable of meshing with the second intermediate gear 123.

The second swinging gear 126 having the above-described configuration can transmit the drive force received from the input gear 121 to the second intermediate gear 123, reducing the speed of the drive force. In other words, the second swinging gear 126 outputs the drive force at a slower speed than the drive force inputted into the second swinging gear 126. Thus, the small-diameter gear 126*c* of the second swinging gear 126 can transmit the drive force whose speed is slower than that of the drive force inputted into the large-diameter gear 126*b* of the second swinging gear 126 to the second intermediate gear 123.

The revolving member 127 is configured to revolve by the drive force transmitted from the motor 4 to the input gear 121 as a revolving force. That is, the revolving member 127 can revolve in the rotating direction of the input gear 121 by a friction force generated between the input gear 121 and the revolving member 127 when the input gear 121 is rotated by the drive force from the motor 4.

The revolving member 127 supports the first swinging gear 125 and the second swinging gear 126 such that the first swinging gear 125 can rotate about an axis of a rotational shaft 125*a* of the first swinging gear 125 and the second swinging gear 126 can rotate about an axis of the rotational shaft 126*a* of the second swinging gear 126.

Incidentally, the first planetary gear 125 and the second planetary gear 126 may not have the rotational shaft 125*a* and the rotational shaft 126*a*, respectively, and the revolving member 127 may have shaft portions at which the first planetary gear 125 and the second planetary gear 126 are rotatably supported.

The revolving member 127 revolves or pivotally moves about the axis of the rotation shaft 121*a*, so that the first swinging gear 125 and the second swinging gear 126 can swingably move about the axis of the rotation shaft 121*a* while the first swinging gear 125 and the second swinging gear 126 mesh with the input gear 121.

That is, the revolving member 127 supports the first swinging gear 125 and the second swinging gear 126 such that the first swinging gear 125 and the second swinging gear 126 can swingably move about the axis of the rotation shaft 121*a* of the input gear 121 while meshing with the input gear 121.

Figure 14:
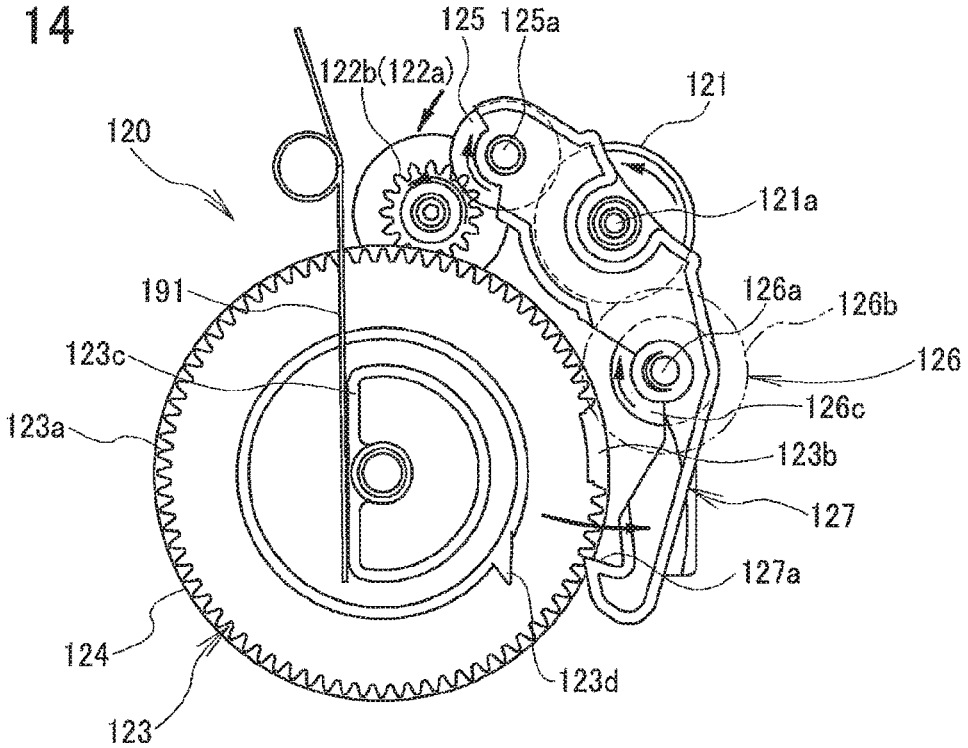
FIG. 14 is a side view of the second transmission mechanism according to the second embodiment when the motor is rotated in the reverse direction, particularly illustrating the relationship between the first drive gear and the first swinging gear and the relationship between the second intermediate gear and the second swinging gear.

The revolving member 127 is configured to revolve between a first revolving position (a revolving position of the revolving member 127 illustrated in FIG. 14) where the first swinging gear 125 meshes with the first drive gear 122*a* and the small-diameter gear 126*c* of the second swinging gear 126 is separated from the second intermediate gear 123 and a second revolving position (a revolving position of the revolving member 127 illustrated in FIG. 13) where the small-diameter gear 126*c* of the second swinging gear 126 is capable of meshing with the second intermediate gear 123 and the first swinging gear 125 is separated from the first drive gear 122*a*.

The revolving member 127 moves to the first revolving position when the motor 4 supplies the drive force in the reverse direction, while the revolving member 127 moves to the second revolving position when the motor 4 supplies the drive force in the normal direction.

Hereinafter, the first swinging gear 125 when the revolving member 127 is located at the first revolving position (i.e., the first swinging gear 125 located at a position meshing with the first drive gear 122*a*) will also be referred to as "the first swinging gear 125 at the first revolving position". Similarly, the second swinging gear 126 when the revolving member 127 is located at the first revolving position (i.e., the small-diameter gear 126*c* located at a position separated from the second intermediate gear 123) will also be referred to as "the second swinging gear 126 at the first revolving position".

Further, the first swinging gear 125 when the revolving member 127 is located at the second revolving position (i.e., the first swinging gear 125 located at a position separated from the first drive gear 122*a*) will also be referred to as "the first swinging gear 125 at the second revolving position". Similarly, the second swinging gear 126 when the revolving member 127 is located at the second revolving position (i.e., the small-diameter gear 126*c* located at a position capable of meshing with the second intermediate gear 123) will also be referred to as "the second swinging gear 126 at the second revolving position".

When the second intermediate gear 123 is located at a rotation position where the toothed part 123*a* confronts the small-diameter gear 126*c* of the second swinging gear 126 while the revolving member 127 is located at the second revolving position, the small-diameter gear 126*c* meshes with the toothed part 123*a*. This allows a rotation force of the second swinging gear 126 to be transmitted to the second intermediate gear 123.

On the other hand, when the second intermediate gear 123 is located at a rotation position where the toothless part 123*b* confronts the small-diameter gear 126*c* of the second swinging gear 126 while the revolving member 27 is located at the second revolving position, the small-diameter gear 126*c* does not mesh with the toothed part 123*a*. Hence, the rotation force of the second swinging gear 126 is not transmitted to the second intermediate gear 123.

When the revolving member 127 is located at the second revolving position, the first swinging gear 125 is separated from the first drive gear 122*a*. Hence, the first swinging gear 125 does not mesh with the first drive gear 122*a*. Accordingly, a rotation force of the first swinging gear 125 is not transmitted to the first drive gear 122*a*.

When the revolving member 127 is located at the first revolving position, the first swinging gear 125 meshes with the first drive gear 122*a*. This allows the rotation force of the first swinging gear 125 to be transmitted to the first drive gear 122*a*.

Further, when the revolving member 127 is located at the first revolving position, the small-diameter gear 126*c* of the second swinging gear 126 is separated from the second intermediate gear 123. Hence, the small-diameter gear 126*c* does not mesh with the toothed part 123*a* regardless of the rotation position of the second intermediate gear 123. Accordingly, the rotation force of the second swinging gear 126 is not transmitted to the second intermediate gear 123.

The resilient member 191 provided at the second transmission mechanism 120 urges the cam part 123*c* of the second intermediate gear 123. In the present embodiment, the resilient member 191 is formed of a torsion coil spring.

The resilient member 191 abuts against a boundary between the arcuate portion and the linear portion in the cam part 123*c* to urge the cam part 123*c*. Hence, the second intermediate gear 123 is rotated by the urging force of the resilient member 191.

Specifically, the resilient member 191 is configured to abut against the boundary between the arcuate portion and the liner portion in the cam part 123*c* when at least the second intermediate gear 123 is located at the rotation position where the toothless part 123*b* confronts the small-diameter gear 126*c* of the second swinging gear 126 at the second revolving position. As the cam part 123*c* is urged by the resilient member 191 abutting against the boundary, the second intermediate gear 123 at this rotation position can be rotated to a rotation position where the toothed part 123*a* confronts the small-diameter gear 126*c* of the second swinging gear 126 at the second revolving position.

The revolving member 127 has an engaging part 127*a* engageable with the engagement part 123*d* of the second intermediate gear 123. When the revolving member 127 is located at the second revolving position, the engaging part 127*a* is located at a lock position where the engaging part 127*a* is in engagement with the engagement part 123*d*. When the revolving member 127 is located at the first revolving position, the engaging part 127*a* is located at a lock release position where the engaging part 127*a* is out of engagement with the engagement part 123*d*.

When the engaging part 127*a* is located at the lock position, the second intermediate gear 123 is restricted from rotating. Hence, in a state where the resilient member 191 abuts against the cam part 123*c* to urge the second intermediate gear 123 in its rotating direction centered on the rotational axis A1, the second intermediate gear 123 is maintained at a rotation position where the toothless part 123*b* confronts the small-diameter gear 126*c* of the second swinging gear 126 at the second revolving position.

When the engaging part 127*a* is located at the lock release position, the second intermediate gear 123 is urged in the rotating direction thereof by the urging force of the resilient member 191. This allows the second intermediate gear 123 to be rotated to a rotation position where the small-diameter gear 126*c* of the second swinging gear 126 at the second revolving position meshes with the toothed part 123*a*.

In this way, when the engaging part 127*a* is located at the lock position, the locking mechanism of the second transmission mechanism 120 locks the rotation of the second intermediate gear 123 urged by the resilient member 191 at the rotation position where the toothless part 123*b* confronts the small-diameter gear 126*c*, and maintains the second intermediate gear 123 at the rotation position where the toothless part 123*b* confronts the small-diameter gear 126*c*. Further, when the engaging part 127*a* is located at the lock release position, the locking mechanism allows the second intermediate gear 123 urged by the resilient member 191 to be rotated to the rotation position where the small-diameter gear 126*c* meshes with the toothed part 123*a* in response to the movement of the revolving member 127 to the second revolving position.

The engagement part 123*d* of the second intermediate gear 123 and the engaging part 127*a* of the revolving member 127 constitute the locking mechanism.

<Planetary Speed-Increasing Mechanism for Second Transmission Mechanism>

In the second transmission mechanism 120, the second intermediate gear 123, the internal gear 128, the plurality of planetary gears 129, and the sun gear 124*b* constitute a planetary speed-increasing mechanism. The planetary speed-increasing mechanism is configured to transmit the drive force sequentially from the second intermediate gear 123 to the sun gear 124*b* through the plurality of planetary gears 129 while increasing the speed of the drive force in order of the second intermediate gear 123, the plurality of planetary gears 129, and the sun gear 124*b*.

In the planetary speed-increasing mechanism, the plurality of support parts 123*e* of the second intermediate gear 123 that respectively supports the plurality of planetary gears 129 is orbitally moved about the rotational axis A1 when a rotation force of the second swinging gear 126 is inputted into the second intermediate gear 123 to rotate the second intermediate gear 123.

The internal gear 128 is fixed so as not to rotate about the rotational axis A1. Hence, the plurality of planetary gears 129 respectively supported by the plurality of support parts 123*e* is orbitally moved about the rotational axis A1 and rotates about their respective rotational axes A2 while meshing with both the internal gear 128 and the sun gear 124*b*.

As a result, the rotation force of the second intermediate gear 123 is transmitted to the sun gear 124*b* and the first intermediate gear 124*a* so that the sun gear 124*b* and the first intermediate gear 124*a* are rotated at a faster speed than the second intermediate gear 123.

In this way, the planetary speed-increasing mechanism provided in the second transmission mechanism 120 has a configuration for transmitting the rotation force of the second intermediate gear 123 to the first intermediate gear 124*a* so that the rotational speed of the first intermediate gear 124*a* becomes faster than the rotational speed of the second intermediate gear 123.

<Operation of Second Transmission Mechanism According to Second Embodiment>

Next, an operation of the second transmission mechanism 120 having the configuration described above will be described.

Figure 18A:
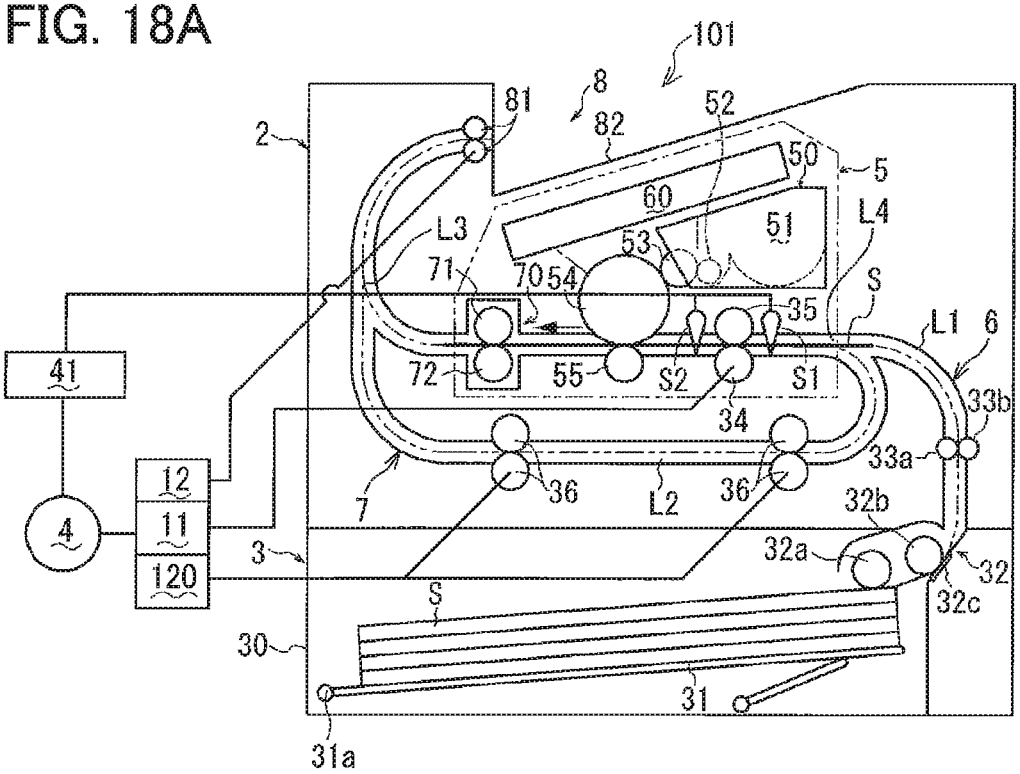
FIG. 18A is a schematic center cross-sectional view of an image forming apparatus according to a second embodiment, illustrating a state where a sheet is conveyed through an image forming unit toward a discharge tray in the image forming apparatus.

First, as illustrated in FIG. 18A, when the motor 4 is rotated in the normal direction under the control of the controller 41, the drive force is transmitted from the motor 4 to the registration roller 34 and other rollers constituting the conveying unit 6 to convey the sheet S in the image forming unit 5 toward the discharge unit 8. At this time, as illustrated in FIG. 13, in the second transmission mechanism 120, the input gear 121 is rotated in the normal direction (clockwise direction in FIG. 13) while receiving the drive force from the motor 4 rotating in the normal direction.

When the input gear 121 is rotated in the normal direction (an example of a second rotating direction), the revolving member 127 revolves in the same direction as the rotating direction of the input gear 121 to be moved to the second revolving position.

In a state where the revolving member 127 is located at the second revolving position, the small-diameter gear 126*c* of the second swinging gear 126 is located at a position capable of meshing with the second intermediate gear 123, and the first swinging gear 125 is separated from the first drive gear 122*a*. Further, in this state, the engaging part 127*a* is located at the lock position where the engaging part 127*a* is in engagement with the engagement part 123*d*. Thus, the second intermediate gear 123 is maintained at the rotation position where the toothless part 123*b* confronts the small-diameter gear 126*c* of the second swinging gear 126 at the second revolving position, while being urged by the resilient member 191 in the rotating direction of the second intermediate gear 123.

In this state, the rotational drive force inputted into the input gear 121 is not transmitted to the first drive gear 122*a* through the first swinging gear 125 since the first swinging gear 125 is separated from the first drive gear 122*a*.

Further, since the toothless part 123*b* is located at a position confronting the small-diameter gear 126*c* of the second swinging gear 126, the small-diameter gear 126*c* does not mesh with the second intermediate gear 123. Hence, the drive force inputted into the input gear 121 is not transmitted to the second intermediate gear 123 through the second swinging gear 126. Accordingly, the rotational drive force inputted into the input gear 121 is not transmitted to the first drive gear 122*a* through the second intermediate gear 123 and the first two-stage gear 124.

In this way, in a state where the engaging part 127*a* is located at the lock position to be engaged with the engagement part 123*d* and the input gear 121 is rotated in the normal direction, the rotation force of the input gear 121 is not transmitted to the first drive gear 122*a*. Thus, the reconveying rollers 36, 36 are not rotated.

Accordingly, when the sheet S is conveyed in the image forming unit 5 toward the discharge unit 8 while the drive force from the motor 4 is transmitted to the conveying unit 6 but the sheet S is not conveyed by the reconveying rollers 36, 36, rotation of the reconveying rollers 36, 36 is halted.

Figure 18B:
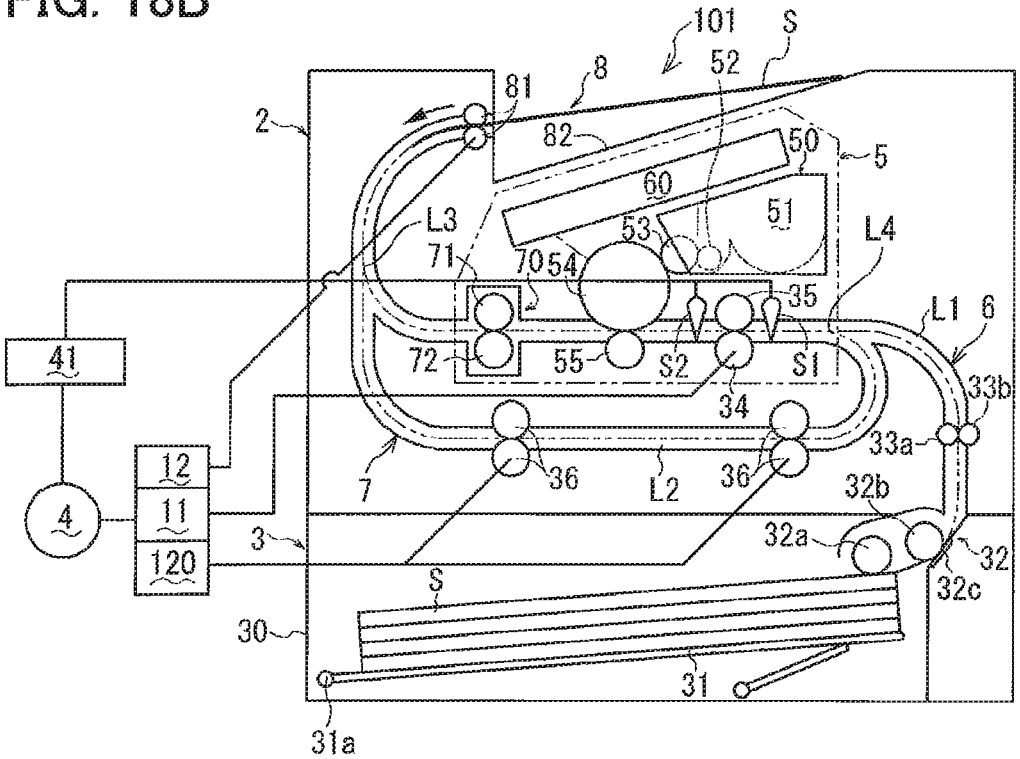
FIG. 18B is a schematic center cross-sectional view of the image forming apparatus according to the second embodiment, illustrating a state where the sheet that has been conveyed toward the discharge tray by switchback rollers is then conveyed toward a reconveying unit.

Next, as illustrated in FIG. 18B, the sheet S conveyed in the image forming unit 5 by the conveying unit 6 is discharged from the image forming unit 5, and the sheet S discharged from the image forming unit 5 is then conveyed toward the discharge tray 82 by the switchback rollers 81, 81. After the switchback rollers 81, 81 convey the sheet S toward the discharge tray 82, the rotating direction of the motor 4 is switched from the normal direction to the reverse direction under the control of the controller 41. This causes the switchback rollers 81, 81 to reconvey the sheet S toward the reconveying unit 7. At this time, as illustrated in FIG. 14, the rotating direction of the input gear 121 is switched from the normal direction to the reverse direction (counterclockwise direction in FIG. 14) as the input gear 121 receives the drive force from the motor 4 rotating in the reverse direction.

Note that a timing at which the mode of the switchback rollers 81, 81 is switched from the first mode in which the sheet S is conveyed toward the discharge tray 82 to the second mode in which the sheet S is reconveyed toward the reconveying unit 7 can be set to a timing at which a predetermined time period has elapsed after the trailing edge of the sheet S conveyed by the conveying unit 6 along the conveying path L1 reaches the post-registration sensor S2 and the post-registration sensor S2 is rendered OFF.

When the rotating direction of the input gear 121 is switched to the reverse direction (an example of a first rotating direction), the revolving position of the revolving member 127 is switched from the second revolving position to the first revolving position. When the revolving member 127 is located at the first revolving position, the first swinging gear 125 meshes with the first drive gear 122*a*, and the small-diameter gear 126*c* of the second swinging gear 126 is separated from the second intermediate gear 123. Hence, the rotational drive force inputted into the input gear 121 is transmitted to the first drive gear 122*a* through the first swinging gear 125. On the other hand, the small-diameter gear 126*c* does not mesh with the second intermediate gear 123. Hence, the rotational drive force inputted into the input gear 121 is not transmitted to the second intermediate gear 123 through the second swinging gear 126.

When the rotational drive force inputted into the input gear 121 is transmitted to the first drive gear 122*a* through the first swinging gear a25, the first drive gear 122*a* is rotated in the reverse direction that is the same direction as the rotating direction of the input gear 121. When the first drive gear 122*a* is rotated in the reverse direction, the reconveying rollers 36, 36 are driven to rotate in the reconveying mode for conveying the sheet S in the reconveying direction from the branch portion L3 toward the rejoining portion L4 along the reconveying path L2.

In this case, since the one-way clutch 122*c* disposed between the first drive gear 122*a* and the second drive gear 122*b* is configured so as not to transmit the rotation of the first drive gear 122*a* rotationally driven by the first swinging gear 125 to the second drive gear 122*b*, the second drive gear 122*b* is not rotationally driven even when the first drive gear 122*a* is rotated in the reverse direction.

Figure 19A:
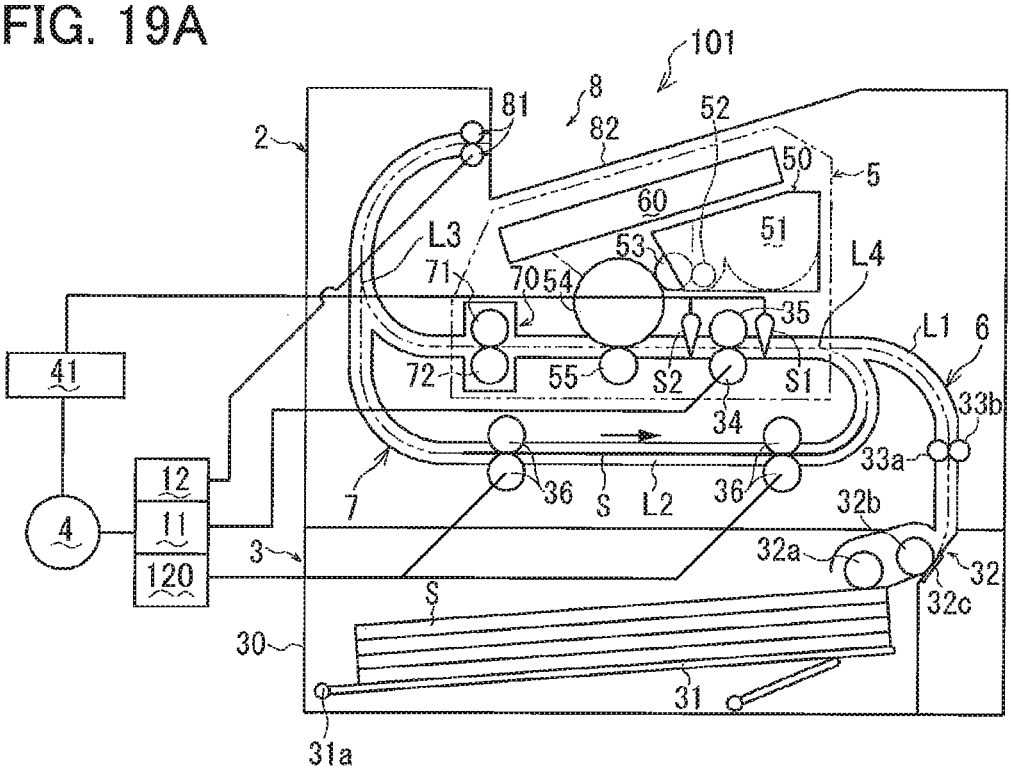
FIG. 19A is a schematic center cross-sectional view of the image forming apparatus according to the second embodiment, illustrating a state where the sheet is conveyed toward the image forming unit along the reconveying path by reconveying rollers.

After the reconveying rollers 36, 36 start rotating, the sheet S conveyed by the switchback rollers 81, 81 toward the reconveying unit 7 is received by the reconveying rollers 36, 36. As illustrated in FIG. 19A, the sheet S is conveyed by the reconveying rollers 36, 36 in the reconveying direction from the branch portion L3 toward the rejoining portion L4 along the reconveying path L2.

While the input gear 121 is rotated in the reverse direction, the revolving member 127 is located at the first revolving position, and the engaging part 127*a* is located at the lock release position. Thus, the engagement between the engaging part 127*a* and the engagement part 123*d* is released.

When the engagement between the engaging part 127*a* and the engagement part 123*d* is released, the second intermediate gear 123 is rotated in the same direction (clockwise direction in FIG. 14) as the normal direction of the input gear 121 by the urging force of the resilient member 191. In this case, the second intermediate gear 123 is rotated to the rotation position (an example of a third rotation position) where the small-diameter gear 126*c* of the second swinging gear 126 at the second revolving position meshes with the toothed part 123*a*.

Figure 15:
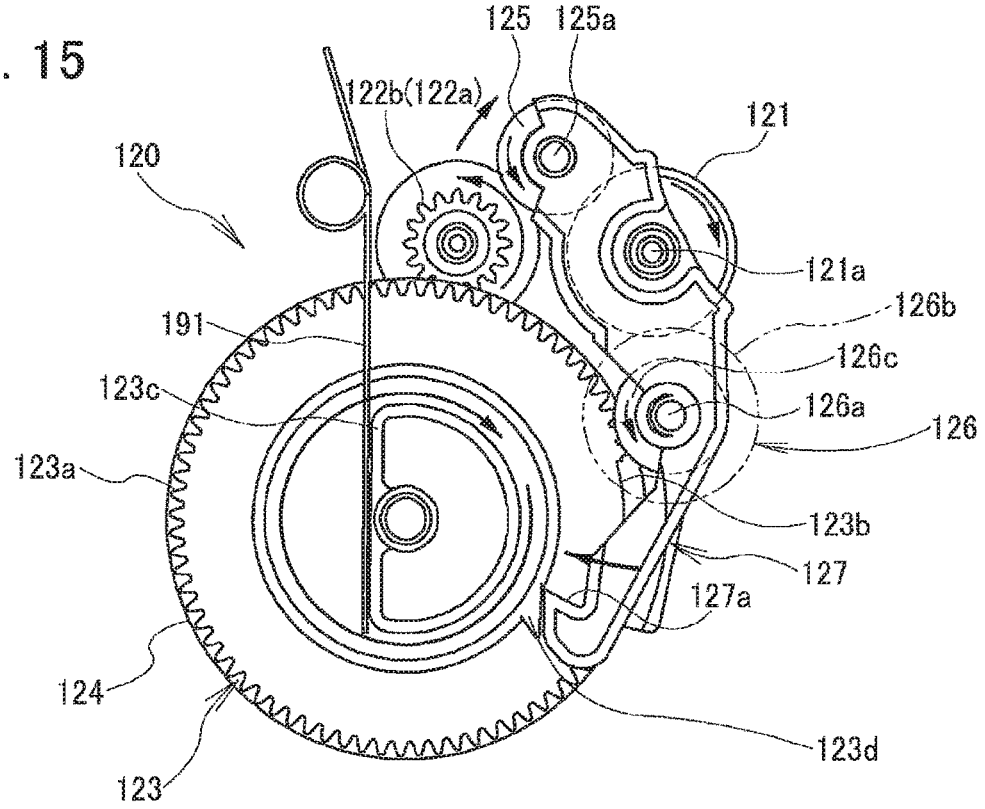
FIG. 15 is a side view of the second transmission mechanism according to the second embodiment when the rotating direction of the motor is switched from the reverse direction to the normal direction, particularly illustrating the relationship between the first drive gear and the first swinging gear and the relationship between the second intermediate gear and the second swinging gear.
Figure 19B:
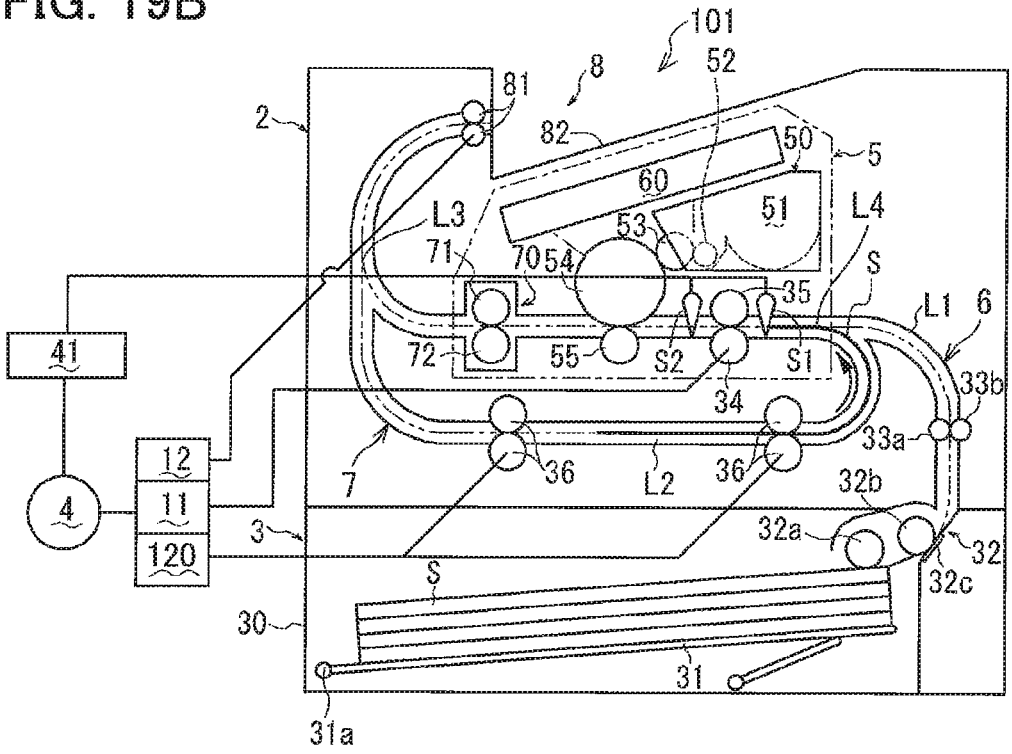
FIG. 19B is a schematic center cross-sectional view of the image forming apparatus according to the second embodiment, illustrating a state where a leading edge of the sheet conveyed along the reconveying path by the reconveying rollers reaches a pre-registration sensor positioned upstream relative to a registration roller in a conveying direction of the sheet.

Then, as illustrated in FIG. 19B, when the leading edge of the sheet S conveyed by the reconveying rollers 36, 36 along the reconveying path L2 reaches the pre-registration sensor S1 and the pre-registration sensor S1 is rendered ON, the rotating direction of the motor 4 is switched from the reverse direction to the normal direction under the control of the controller 41. When the rotating direction of the motor 4 is switched to the normal direction, the rotating direction of the input gear 121 is switched from the reverse direction to the normal direction (clockwise direction in FIG. 15) as illustrated in FIG. 15. Further, when the rotating direction of the motor 4 is switched to the normal direction, the registration roller 34 and other rollers constituting the conveying unit 6 starts rotating.

When the input gear 121 is rotated in the normal direction, the revolving member 127 revolves in the same direction as the rotating direction of the input gear 121 to be moved from the first revolving position to the second revolving position. When the revolving member 127 is moved to the second revolving position, the small-diameter gear 126*c* of the second swinging gear 126 moves toward the second intermediate gear 123 to mesh with the toothed part 123*a*. On the other hand, the first swinging gear 125 separates from the first drive gear 122*a*.

As a result, the rotational drive force from the input gear 121 is transmitted to the second intermediate gear 123 through the second swinging gear 126.

Figure 16:
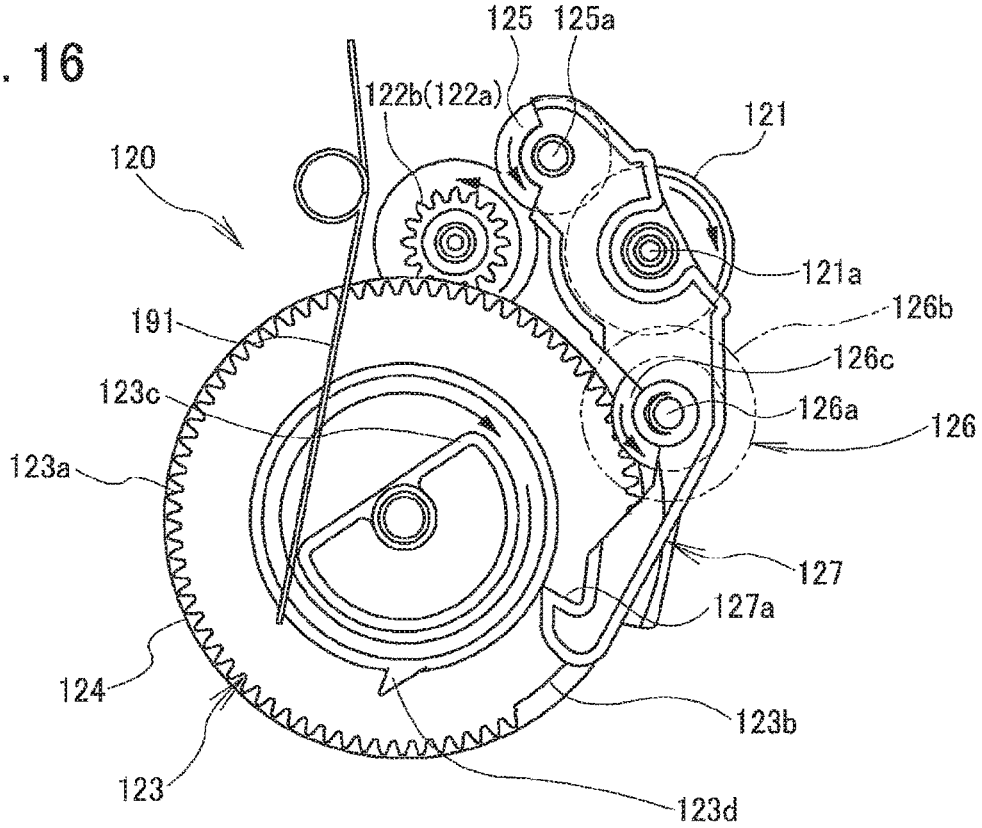
FIG. 16 is a side view of the second transmission mechanism according to the second embodiment, illustrating a state where the second intermediate gear is rotated by a drive force transmitted through the second swinging gear to transmit a drive force whose speed is increased by a planetary speed-increasing mechanism to the first drive gear through a first intermediate gear and a second drive gear, and the first drive gear is rotationally driven by the drive force having a faster speed, and particularly illustrating the relationship between the first drive gear and the first swinging gear and the relationship between the second intermediate gear and the second swinging gear.
Figure 17:
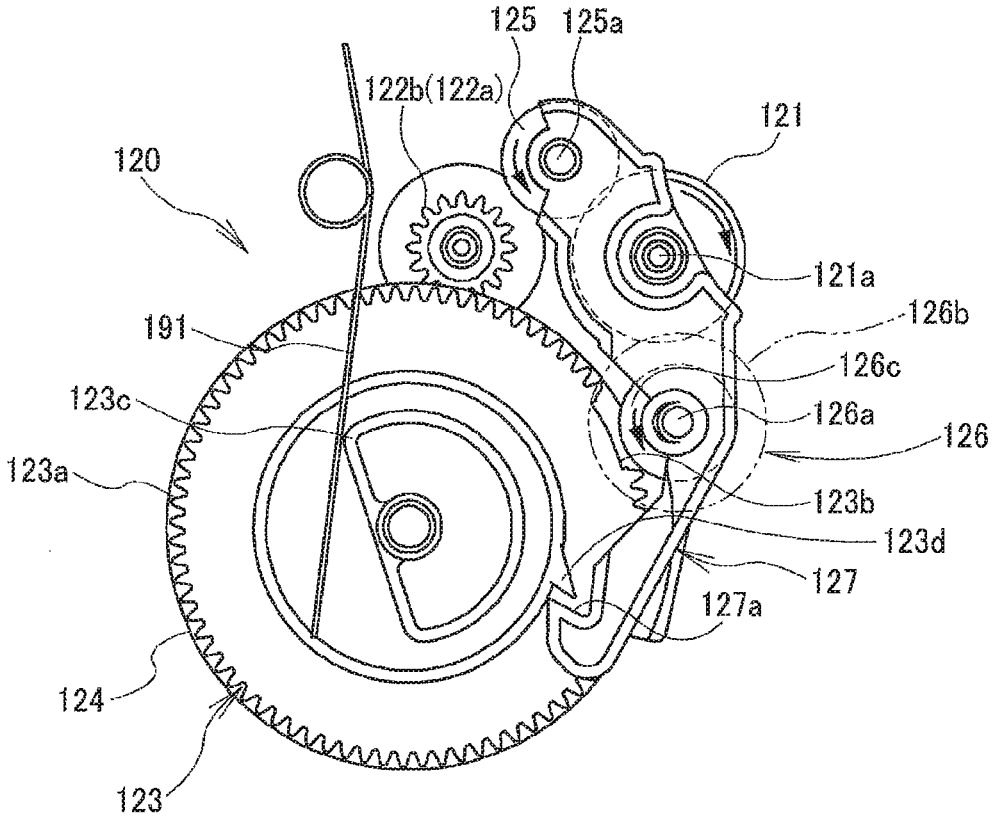
FIG. 17 is a side view of the second transmission mechanism according to the second embodiment, illustrating a state where the second intermediate gear has been rotated by almost 360 degrees after the rotating direction of the motor is switched from the reverse direction to the normal direction, and particularly illustrating the relationship between the first drive gear and the first swinging gear and the relationship between the second intermediate gear and the second swinging gear.

When the revolving member 127 is located at the second revolving position, the engaging part 127*a* is located at the lock position. However, at the rotation position of the second intermediate gear 123 illustrated in FIG. 15 where the small-diameter gear 126*c* meshes with the toothed part 123*a*, the engagement part 123*d* is positioned downstream relative to a position engageable with the engaging part 127*a* in the rotation direction of the second intermediate gear 123. Thus, the engagement part 123*d* does not engage with the engaging part 127*a*, and therefore, as illustrated in FIG. 16, the second intermediate gear 123 is rotated in the same direction as the rotating direction of the input gear 121 by the rotational drive force transmitted thereto through the second swinging gear 126.

When the second intermediate gear 123 is rotated, the plurality of planetary gears 129 is orbitally moved about the rotational axis A1 and rotated about their respective rotational axes A2 while meshing with both the internal gear 128 and the sun gear 124*b*, as described above. As a result, the rotation of the second intermediate gear 123 is transmitted to the sun gear 124*b* and the first intermediate gear 124*a* so that the sun gear 124*b* and the first intermediate gear 124*a* are rotated at a faster speed than the second intermediate gear 123.

When the drive force from the second intermediate gear 123 is transmitted to the first intermediate gear 124*a* through the sun gear 124*b*, the second drive gear 122*b* is rotationally driven by the first intermediate gear 124*a*. Since the one-way clutch 122*c* disposed between the second drive gear 122*b* and the first drive gear 122*a* is configured so as to transmit the rotation of the second drive gear 122*b* rotationally driven by the first intermediate gear 124*a* to the first drive gear 122*a*, the first drive gear 122*a* is rotationally driven together with the second drive gear 122*b*.

In this case, the first drive gear 122*a* is driven to rotate in the reverse direction that is a direction opposite to the rotating direction of the input gear 121.

When the first drive gear 122*a* is rotated in the reverse direction, the reconveying rollers 36, 36 are driven to rotate in the reconveying mode for conveying the sheet S in the reconveying direction from the branch portion L3 toward the rejoining portion L4 along the reconveying path L2.

In this way, when the rotating direction of the motor 4 is switched from the reverse direction to the normal direction, the second transmission mechanism 120 operates in the second transmission mode that reverses the direction of the rotational drive force supplied from the motor 4 and outputs the reversed drive force toward the reconveying rollers 36, 36.

The second intermediate gear 123 rotationally driven through the second swinging gear 126 is rotated in the clockwise direction from a rotation position where the small-diameter gear 126*c* of the second swinging gear 126 meshes with a furthest upstream portion of the toothed part 123*a* adjacent to the toothless part 123*b* and positioned on an upstream side of the toothless part 123*b* in the rotating direction to a rotation position where the small-diameter gear 126*c* of the second swinging gear 126 meshes with a furthest downstream portion of the toothed part 123*a* adjacent to the toothless part 123*b* and positioned on a downstream side of the toothless part 123*b* in the rotating direction, and then, to the rotation position where the toothless part 123*b* confronts the small-diameter gear 126*c*. When the toothless part 123*b* reaches a position confronting the small-diameter gear 126*c*, the drive force is not transmitted to the second intermediate gear 123 through the second swinging gear 126. As a result, the rotation of the second intermediate gear 123 by this drive force is halted.

That is, when the rotating direction of the motor 4 is switched from the reverse direction to the normal direction, the reconveying rollers 36, 36 are driven to rotate in the reconveying mode by the predetermined number of rotations while the second intermediate gear 123 is rotated by almost one rotation from the rotation position where the small-diameter gear 126*c* meshes with the furthest upstream portion of the toothed part 123*a* to the rotation position where the small-diameter gear 126*c* meshes with the furthest downstream portion of the toothed part 123*a*. Hence, the sheet S continues to be conveyed toward the image forming unit 5 by the reconveying rollers 36, 36.

In this way, while the second intermediate gear 123 is rotated by almost one rotation through the second swinging gear 126, the rotation of the second intermediate gear 123 is transmitted to the first intermediate gear 124*a* so that the first intermediate gear 124*a* is rotated at a faster speed than the second intermediate gear 123 through the planetary speed-increasing mechanism. This configuration can increase the number of rotations of the reconveying rollers 36, 36 during the almost one rotation of the second intermediate gear 123, enabling the reconveying rollers 36, 36 to be rotated until the trailing edge of the sheet S is conveyed to a position past the reconveying rollers 36, 36.

Further, at a time point when the rotation of the second intermediate gear 123 is halted, the leading edge of the sheet S is positioned downstream relative to the registration roller 34 in the conveying direction. Thereafter, the sheet S is conveyed by the registration roller 34 and other rollers constituting the conveying unit 6 along the conveying path L1.

As illustrated in FIG. 7, when the second intermediate gear 123 rotationally driven through the second swinging gear 126 is rotated from the rotation position (an example of a first rotation position) where the furthest downstream portion of the toothed part 123*a* confronts the small-diameter gear 126*c* of the second swinging gear 126 to the rotation position (an example of a second rotation position) where the toothless part 123*b* confronts the small-diameter gear 126*c* of the second swinging gear 126, the resilient member 191 abuts against the boundary in the cam part 123*c* of the second intermediate gear 123 to rotate the second intermediate gear 123 by the urging force of the resilient member 191.

The second intermediate gear 123 rotated by the urging force of the resilient member 191 stops rotating when reaching the rotation position where the engagement part 123*d* is engaged with the engaging part 127*a*, and is maintained at the rotation position where the toothless part 123*b* confronts the second swinging gear 126.

<Operational Advantages of Second Embodiment>

According to the second embodiment, the image forming apparatus 101 is configured as described above.

That is, the image forming apparatus 101 includes the sheet cassette 30, the image forming unit 5, the discharge tray 82, the conveying unit 6, the reconveying unit 7, the switchback rollers 81, 81, the motor 4, the first transmission mechanism 11, and the second transmission mechanism 120.

The reconveying unit 7 includes the reconveying rollers 36, 36.

The second transmission mechanism 120 transmits a drive force to the reconveying rollers 36, 36 to rotate the reconveying rollers 36, 36 in the reconveying mode for conveying the sheet S in the reconveying direction from the branch portion L3 toward the rejoining portion L4 while the motor 4 supplies a drive force in the reverse direction to the second transmission mechanism 120. Further, the second transmission mechanism 120 transmits a drive force to the reconveying rollers 36, 36 to rotate the reconveying rollers 36, 36 by the predetermined number of rotations in the reconveying mode for conveying the sheet S in the reconveying direction from the branch portion L3 toward the rejoining portion L4 after the rotating direction of the drive force supplied from the motor 4 is switched from the reverse direction to the normal direction, and then, interrupts transmission of the drive force to the reconveying rollers 36, 36.

The second transmission mechanism 120 includes the input gear 121, the first drive gear 122*a*, the second drive gear 122*b*, the first swinging gear 125, the second swinging gear 126, the first two-stage gear 124 including the first intermediate gear 124*a* and the sun gear 124*b*, the internal gear 128, the plurality of planetary gears 129, the second intermediate gear 123, the one-way clutch 122*c*, the revolving member 127, the resilient member 191, and the locking mechanism.

With this configuration, while the reconveying rollers 36, 36 do not convey the sheet S, rotation of the reconveying rollers 36, 36 is stopped. Thus, noise caused by the reconveying rollers 36, 36 can be reduced, and frictional wearing of the reconveying rollers 36, 36 and their neighboring components can be restrained.

When the drive force is transmitted to the reconveying rollers 36, 36 to rotate the reconveying rollers 36, 36 by the predetermined number of rotations in the reconveying mode after the rotating direction of the drive force supplied from the motor 4 is switched from the reverse direction to the normal direction, it is preferable to rotate the reconveying rollers 36, 36 until the trailing edge of the sheet S is conveyed to a position past the reconveying rollers 36, 36 in order to make the conveying speed of the sheet S stable.

In this regard, the second transmission mechanism 120 according to the second embodiment includes the planetary speed-increasing mechanism that sequentially transmits a drive force to the second intermediate gear 123, the plurality of planetary gears 129, and the sun gear 124*b* while increasing the speed of the drive force.

Thus, as compared to a case where a drive force is directly transmitted from the second intermediate gear 123 to the first intermediate gear 124*a*, the reconveying rollers 36, 36 can be rotated until the trailing edge of the sheet S is conveyed to a position past the reconveying rollers 36, 36 while increasing the number of rotations of the reconveying rollers 36, 36, without enlarging the size of the second transmission mechanism 120.

The locking mechanism includes the engagement part 123*d* and the engaging part 127*a*. The engagement part 123*d* is provided at the second intermediate gear 123. The engaging part 127*a* is provided at the revolving member 127 and engageable with the engagement part 123*d*. When the revolving member 127 is located at the second revolving position, the engaging part 127*a* is located at the lock position where the engaging part 127*a* is in engagement with the engagement part 123*d*. When the revolving member 127 is located at the first revolving position, the engaging part 127*a* is located at the lock release position where the engaging part 127*a* is out of engagement with the engagement part 123*d*. When located at the lock position, the engaging part 127*a* is in engagement with the engagement part 123*d* to lock the rotation of the second intermediate gear 123 at the rotation position where the toothless part 123*b* is located at a position confronting the second swinging gear 126.

When the engaging part 127*a* is located at the lock position, the locking mechanism maintains the second intermediate gear 123 at the rotation position where the toothless part 123*b* is located at a position confronting the second swinging gear 126 by the urging force of the resilient member 191. When the engaging part 127*a* is located at the lock release position, the locking mechanism allows the second intermediate gear 123 to be rotated by the urging force of the resilient member 191 to the rotation position where the second swinging gear 126 meshes with the toothed part 123*a* in response to the movement of the revolving member 127 to the second revolving position.

Thus, even if the urging force of the resilient member 191 is set to be small, the second intermediate gear 123 can reliably be maintained, by the urging force of the resilient member 191, at the rotation position where the toothless part 123*b* is located at a position confronting the second swinging gear 126 when the engaging part 127*a* is located at the lock position. Further, the second intermediate gear 123 can reliably be rotated, by the urging force of the resilient member 191, to the rotation position where the second swinging gear 126 meshes with the toothed part 123*a* of the second intermediate gear 123 when the engaging part 127*a* is located at the lock release position.

Further, the second swinging gear 126 is a second two-stage gear including the large-diameter gear 126*b* and the small-diameter gear 126*c*. The large-diameter gear 126*b* meshes with the input gear 121. The small-diameter gear 126*c* can be rotated integrally with the large-diameter gear 126*b* about a rotation axis of the large-diameter gear 126*b*. The small-diameter gear 126*c* has gear teeth whose number is smaller than that of gear teeth of the large-diameter gear 126*b*. The small-diameter gear 126*c* is capable of meshing with the second intermediate gear 123.

The second swinging gear 126 with this configuration can transmit the drive force from the input gear 121 to the second intermediate gear 123, while reducing the speed of the drive force. Accordingly, the planetary speed-increasing mechanism can smoothly be operated for sequentially transmitting the drive force to the second intermediate gear 123, the plurality of planetary gears 129, and the sun gear 124*b* while increasing the speed of the drive force.

While the description has been made in detail with reference to the embodiments thereof, it would be apparent to those skilled in the art that many modifications and variations may be made therein without departing from the scope of the disclosure.

What is claimed is:

1. An image forming apparatus comprising:

a sheet support portion configured to support a sheet;

an image forming unit configured to form an image on the sheet;

a tray configured to support the sheet on which the image has been formed;

a conveying unit configured to convey the sheet along a conveying path, the conveying path leading from the sheet support portion to the tray via the image forming unit;

a reconveying unit configured to convey the sheet on which the image has been formed along a reconveying path, the reconveying path branching from the conveying path at a branch portion located between the image forming unit and the tray and rejoining the conveying path at a rejoining portion located between the sheet support portion and the image forming unit, the reconveying unit comprising a reconveying roller configured to rotate in a reconveying mode for conveying the sheet in a first direction from the branch portion toward the rejoining portion;

a switchback roller configured to rotate in a first mode for conveying the sheet in a second direction from the image forming unit toward the tray and in a second mode for conveying the sheet in a third direction from the tray toward the reconveying unit;

a drive source configured to selectively rotate in a first rotational direction and in a second rotational direction opposite to the first rotational direction to supply a drive force for conveying the sheet;

a first transmission mechanism transmitting the drive force from the drive source to the conveying unit when the drive source rotates in the first rotational direction, the first transmission mechanism interrupting transmission of the drive force from the drive source to the conveying unit when the drive source rotates in the second rotational direction; and a second transmission mechanism transmitting the drive force from the drive source to the reconveying roller to rotate the reconveying roller in the reconveying mode when the drive source rotates in the second rotational direction, the second transmission mechanism transmitting the drive force from the drive source to the reconveying roller to rotate the reconveying roller by predetermined numbers of rotations in the reconveying mode after the drive source is switched from rotating in the second rotational direction to the first rotational direction and then interrupting transmission of the drive force from the drive source to the reconveying roller, the second transmission mechanism comprising:

an input gear configured to rotate upon receipt of the drive force from the drive source;

a first drive gear configured to output the drive force to the reconveying roller;

a second drive gear configured to rotate coaxially with the first drive gear;

a first swinging gear meshing with the input gear;

a second swinging gear meshing with the input gear;

a first two-stage gear comprising:

a first intermediate gear meshing with the second drive gear and having a first rotational axis; and a sun gear configured to rotate integrally with the first intermediate gear about the first rotational axis;

an internal gear having an inner peripheral surface on which gear teeth are formed and having a center axis coincident with the first rotational axis, the internal gear being stationary and incapable of rotating;

a plurality of planetary gears disposed between the sun gear and the internal gear and meshing with the sun gear and the internal gear, the plurality of planetary gears each having a second rotational axis;

a second intermediate gear configured to rotate about the first rotational axis, the second intermediate gear supporting the plurality of planetary gears such that the plurality of planetary gears is rotatable about the second rotational axis, respectively and orbitally movable about the first rotational axis, the second intermediate gear being configured to rotate relative to the first two-stage gear and the internal gear, the second intermediate gear including a toothed part having gear teeth and a toothless part having no gear teeth;

a one-way clutch disposed between the first drive gear and the second drive gear, the one-way clutch transmitting rotation of the second drive gear driven by the first intermediate gear to the first drive gear, the one-way clutch interrupting transmission of rotation of the first drive gear driven by the first swinging gear to the second drive gear;

a revolving member supporting the first swinging gear and the second swinging gear such that:

the first swinging gear is rotatable about a rotation axis of the first swinging gear;

the second swinging gear is rotatable about a rotation axis of the second swinging gear; and the first swinging gear and the second swinging gear are swingably movable about a rotation axis of the input gear while meshing with the input gear, respectively, the drive force transmitted from the drive source to the input gear acting as a revolving force for revolving the revolving member, the revolving member being configured to revolve between a first revolving position where the first swinging gear meshes with the first drive gear and the second swinging gear is separated from the second intermediate gear and a second revolving position where the first swinging gear is separated from the first drive gear and the second swinging gear is capable of meshing with the second intermediate gear, the revolving member being moved to the first revolving position when the drive source rotates in the second rotational direction and moved to the second revolving position when the drive source rotates in the first rotational direction;

an urging member configured to urge the second intermediate gear in a rotating direction of the second intermediate gear to rotate the second intermediate gear from a first rotation position where the toothed part is located at a position confronting the second swinging gear to a second rotation position where the toothless part is located at a position confronting the second swinging gear; and a locking mechanism configured to lock the rotation of the second intermediate gear at the second rotation position.

2. The image forming apparatus according to claim 1, wherein the locking mechanism comprises:

an engagement part provided at the second intermediate gear; and an engaging part provided at the revolving member and engageable with the engagement part, the engaging part being located at a lock position where the engaging part is in engagement with the engagement part when the revolving member is at the second revolving position, the engaging part being located at a lock release position where the engaging part is out of engagement with the engagement part when the revolving member is at the first revolving position, wherein the locking mechanism locks the rotation of the second intermediate gear at the second rotation position in accordance with engagement of the engaging part with the engagement part when the engaging part is at the lock position, wherein, when the engaging part is at the lock position, the locking mechanism maintains the second intermediate gear at the second rotation position by an urging force of the urging member, and wherein, when the engaging part is at the lock release position, the locking mechanism allows the second intermediate gear to be rotated by the urging force of the urging member to a third rotation position where the second swinging gear meshes with the toothed part in response to movement of the revolving member to the second revolving position.

3. The image forming apparatus according to claim 1, wherein the second swinging gear comprises a second two-stage gear including:

a large-diameter gear meshing with the input gear; and a small-diameter gear configured to rotate coaxially and integrally with the large-diameter gear, the small-diameter gear having gear teeth whose number is smaller than that of gear teeth of the large-diameter gear, the small-diameter gear being capable of meshing with the second intermediate gear.

4. The image forming apparatus according to claim 1, further comprising a third transmission mechanism transmitting the drive force from the drive source to the switchback roller to rotate the switchback roller in the first mode when the drive source rotates in the first rotational direction, the third transmission mechanism transmitting the drive force from the drive source to the switchback roller to rotate the switchback roller in the second mode when the drive source rotates in the second rotational direction.

5. A transmission mechanism provided in an image forming apparatus including an image forming unit configured to form an image on a sheet; a roller configured to convey the sheet; and a drive source configured to supply a drive force to the image forming unit and the roller, the transmission mechanism being configured to transmit the drive force from the drive source to the roller, the transmission mechanism comprising:

an input gear configured to rotate upon receipt of the drive force from the drive source;

a first drive gear configured to output the drive force to the roller;

a second drive gear configured to rotate coaxially with the first drive gear;

a first swinging gear meshing with the input gear;

a second swinging gear meshing with the input gear;

a first two-stage gear comprising:

a first intermediate gear meshing with the second drive gear and having a first rotational axis; and a sun gear configured to rotate integrally with the first intermediate gear about the first rotational axis;

an internal gear having an inner peripheral surface on which gear teeth are formed and having a center axis coincident with the first rotational axis, the internal gear being stationary and incapable of rotating;

a plurality of planetary gears disposed between the sun gear and the internal gear and meshing with the sun gear and the internal gear, the plurality of planetary gears each having a second rotational axis;

a second intermediate gear configured to rotate about the first rotational axis, the second intermediate gear supporting the plurality of planetary gears such that the plurality of planetary gears is rotatable about the second rotational axis, respectively and orbitally movable about the first rotation axis, the second intermediate gear being configured to rotate relative to the first two-stage gear and the internal gear, the second intermediate gear including a toothed part having gear teeth and a toothless part having no gear teeth;

a one-way clutch disposed between the first drive gear and the second drive gear, the one-way clutch transmitting rotation of the second drive gear driven by the first intermediate gear to the first drive gear, the one-way clutch interrupting transmission of rotation of the first drive gear driven by the first swinging gear to the second drive gear;

a revolving member supporting the first swinging gear and the second swinging gear such that:

the first swinging gear is rotatable about a rotation axis of the first swinging gear;

the second swinging gear is rotatable about a rotation axis of the second swinging gear; and the first swinging gear and the second swinging gear are swingably movable about a rotation axis of the input gear while meshing with the input gear, respectively, the drive force supplied from the drive source to the input gear acting as a revolving force for revolving the revolving member, the revolving member being configured to revolve between a first revolving position where the first swinging gear meshes with the first drive gear and the second swinging gear is separated from the second intermediate gear and a second revolving position where the first swinging gear is separated from the first drive gear and the second swinging gear is capable of meshing with the second intermediate gear, the revolving member being moved to the first revolving position when the input gear rotates in a first rotating direction and moved to the second revolving position when the input gear rotates in a second rotating direction;

an urging member configured to urge the second intermediate gear in a rotating direction of the second intermediate gear to rotate the second intermediate gear from a first rotation position where the toothed part is located at a position confronting the second swinging gear to a second rotation position where the toothless part is located at a position confronting the second swinging gear; and a locking mechanism configured to lock the rotation of the second intermediate gear at the second rotation position.

* * * * *